US011572755B2

(12) United States Patent
Ross

(10) Patent No.: US 11,572,755 B2
(45) Date of Patent: Feb. 7, 2023

(54) SEALING ARRANGEMENT

(71) Applicant: Baker Hughes Energy Technology UK Limited, Aberdeenshire (GB)

(72) Inventor: Michael Stanley McRobbie Ross, Inverurie (GB)

(73) Assignee: Baker Hughes Energy Technology UK Limited, Bristol (GB)

( * ) Notice: Subject to any disclaimer, the term of this patent is extended or adjusted under 35 U.S.C. 154(b) by 237 days.

(21) Appl. No.: 16/080,144

(22) PCT Filed: Apr. 4, 2017

(86) PCT No.: PCT/EP2017/058036
§ 371 (c)(1),
(2) Date: Aug. 27, 2018

(87) PCT Pub. No.: WO2017/174611
PCT Pub. Date: Oct. 12, 2017

(65) Prior Publication Data

US 2019/0048678 A1 Feb. 14, 2019

(30) Foreign Application Priority Data

Apr. 8, 2016 (GB) ..... 1606025

(51) Int. Cl.
*E21B 33/037* (2006.01)
*E21B 33/12* (2006.01)
*E21B 33/03* (2006.01)

(52) U.S. Cl.
CPC ..... *E21B 33/037* (2013.01); *E21B 33/03* (2013.01); *E21B 33/1212* (2013.01)

(58) Field of Classification Search
CPC ..... E21B 33/03; E21B 33/037; E21B 33/1212
See application file for complete search history.

(56) References Cited

U.S. PATENT DOCUMENTS 4,691,780 A 9/1987 Galle, Jr. et al.
6,003,602 A * 12/1999 Wilkins ..... E21B 33/035 166/339
6,474,416 B2 * 11/2002 Beall ..... E21B 33/035 166/343
7,637,325 B2 * 12/2009 Goonetilleke ..... E21B 33/035 166/341

(Continued)

FOREIGN PATENT DOCUMENTS

CN 2849137 Y 12/2006
EP 1 336 721 A2 8/2003

(Continued)

OTHER PUBLICATIONS

Search Report issued in connection with corresponding GB Application No. 1606025.3 dated Oct. 18, 2016.

(Continued)

*Primary Examiner* — Aaron L Lembo
(74) *Attorney, Agent, or Firm* — Baker Hughes Patent Org.

(57) ABSTRACT

A sealing arrangement for an oil and/or gas well, including a rotation portion and a sealing portion. Rotation of the rotation portion causes the sealing portion to engage a surface of the oil and/or gas well so as to substantially form a seal therebetween.

24 Claims, 15 Drawing Sheets

(56) References Cited

U.S. PATENT DOCUMENTS

| | | | | |
|---|---|---|---|---|
| 8,739,883 | B2 * | 6/2014 | Aarnes | E21B 23/02 166/368 |
| 9,121,243 | B1 | 9/2015 | Headifen | |
| 2002/0088622 | A1 | 7/2002 | Beall et al. | |
| 2006/0060348 | A1 | 3/2006 | Allen et al. | |
| 2008/0210435 | A1 * | 9/2008 | Goonetilleke | E21B 33/035 166/368 |
| 2013/0069315 | A1 | 3/2013 | Kekarainen | |
| 2014/0060849 | A1 * | 3/2014 | Pathak | E21B 33/037 166/344 |

FOREIGN PATENT DOCUMENTS

| | | | |
|---|---|---|---|
| GB | 1 500 936 | A | 2/1978 |
| GB | 2 326 430 | A | 12/1998 |

OTHER PUBLICATIONS

International Search Report and Written Opinion issued in connection with corresponding PCT Application No. PCT/EP2017/058036 dated Jun. 8, 2017.

International Preliminary Report on Patentability issued in connection with corresponding PCT Application No. PCT/EP2017/058036 dated Oct. 9, 2018.

* cited by examiner

SEALING ARRANGEMENT

BACKGROUND OF THE INVENTION

Embodiments of the present invention relate to a sealing arrangement. More particularly, but not exclusively, embodiments of the present invention relate to a sealing arrangement for an oil and/or gas well cap and method of installation of the sealing arrangement in an oil and/or gas well cap.

Oil and gas are typically extracted from beneath the Earth's surface by wells. Such wells are typically constructed by drilling a wellbore deep into the ground. A number of concentrically aligned tubular pipes, known as tubings or casings, are installed within the wellbore which penetrate to different depths below ground in order to facilitate the extraction of oil and gas from hydrocarbon producing formations of the Earth's crust. The casings are typically secured to one another at a wellhead located just above the Earth's surface. A treehead is mounted above the wellhead, and typically contains an assembly of valves and pipes which regulate the flow of oil and gas from the well. Typically, the treehead is configured to permit access to the wellbore for maintenance or upgrade work by a running tool configured to enter a central tubing of the wellbore. The running tool is typically inserted into the wellbore via an opening of the wellbore situated at the top of the treehead. When maintenance or upgrade work is not being carried out, the opening of the treehead is typically plugged by a cap which seals the wellbore from the surrounding environment to prevent oil leakage. To ensure that further maintenance or upgrade work can be carried out on the well in the future such caps are typically required to be removable. It will be appreciated that if a cap can be installed but not removed, it may not be possible to continue using the well and hence potential revenue from the well may be lost.

In order to provide a cap that is easily removable by a remotely operated vehicle (ROV), such caps are typically provided with an elastomeric sealing element. The force required to insert the cap and the sealing element against the wellbore such that a seal is formed therebetween is known as a setting force. Such elastomeric sealing elements require a relatively low setting force to insert the sealing elements into a sealed position against the wellbore, and therefore caps comprising such elastomeric sealing elements are relatively easy to install or remove. However, in harsh environments (such as for example in sub-sea oil and/or gas wells) such elastomeric sealing elements can degrade relatively quickly, and therefore the sealing element and/or cap may require maintenance or replacement in order to prevent damage to the well.

There have been attempts to incorporate more durable metal sealing elements in caps for oil and/or gas wells. However, metal sealing elements require a relatively high setting force compared to elastomeric sealing elements, and therefore caps containing such metal sealing elements can be difficult to install and remove from wells. Where the well is situated in a harsh environment, such as a sub-sea oil and/or gas well, it will be appreciated that it may be difficult to apply the required setting force to a cap comprising metal sealing elements. In particular, the cap may be required to be installed by an ROV, which may have limited capacity to apply such a setting force. One solution to the problem of applying the required setting force for a cap comprising a metal sealing element is the use of hydraulics. However, it will be appreciated that to avoid the use of hydraulic systems undersea as such systems are highly complex and often impractical for operation by ROVs.

There therefore remains a need for improvements in sealing arrangements and methods of installation of sealing elements.

BRIEF DESCRIPTION OF THE INVENTION

According to a first aspect of embodiments of the invention there is provided a sealing arrangement for an oil and/or gas well, comprising: a rotation portion; and a sealing portion; wherein rotation of the rotation portion causes the sealing portion to engage a surface of the oil and/or gas well so as to substantially form a seal therebetween.

It will be appreciated that in order to form a seal between the sealing portion and the surface of the oil and/or gas well, the sealing portion and the surface of the oil and/or gas well must contact one another in a tight-fitting manner. As such, movement of the sealing portion into the sealed position may be subject to high frictional resistance caused by contact between the tight-fitting parts of the sealing portion and the surface of the oil and/or gas well. A large amount of force is therefore generally required to be applied to the sealing portion in a linear direction to overcome this frictional resistance and push the sealing portion into the sealed position. The force applied to the sealing portion to form the seal is known as the setting force of the seal. Embodiments of the present invention use rotation of the rotation portion to cause a setting force to be applied to the sealing portion.

Where the sealing arrangement is for use in sub-sea conditions, it will be appreciated that it may be difficult to apply a sufficient setting force to the cap. For example, the sealing arrangement may be installed by an ROV which may not be heavy enough to impart the required setting force upon the sealing arrangement using its own weight, or may not be able to generate a sufficient amount of thrust to apply the required setting force using a propulsion system of the ROV. However, it will be appreciated that such ROVs typically comprise torque-producing motors to which a rotational tool may be connected. Embodiments of the present invention therefore, in an embodiment, allow a torque-producing motor to be used to provide the setting force required to seal the sealing arrangement to the oil and/or gas well.

The sealing arrangement may further comprise a first locking arrangement configured to engage the oil and/or gas well. The locking arrangement may be configured to engage the oil and/or gas well such that rotation of the rotation portion urges the sealing portion to a sealed position in which the seal is formed between the sealing portion and the surface of the oil and/or gas well. For example, the first locking arrangement may engage the oil and/or gas well in such a manner that the first locking arrangement locks the sealing arrangement to the oil and/or gas well. During use, when the rotation portion is rotated to apply the setting force to the sealing portion, the first locking arrangement may lock the sealing arrangement to the oil and/or gas well so as to prevent the sealing arrangement separating from the oil and/or gas well. As such, because the first locking arrangement prevents the sealing arrangement from separation from the oil and/or gas well, the sealing arrangement is able to apply a setting force to the sealing portion which is sufficient to overcome the frictional resistance to movement between the sealing portion and the surface of the oil and/or gas well.

Urging of the sealing portion to the sealed position may cause linear movement of the sealing portion. For example, the sealing arrangement may comprise a lead screw mechanism configured to translate rotational motion of the rotation portion to linear movement of the sealing portion.

The sealing arrangement may comprise a first keyway configured to substantially restrict rotation of the sealing portion relative to the sealing arrangement so as cause linear movement of the sealing portion when the rotation portion is rotated. For example, the first keyway may be defined between the sealing portion and a body portion of the sealing arrangement. It will be appreciated that because the first keyway restricts relative rotation between the sealing portion and the sealing arrangement, in response to rotation of the rotation portion the sealing portion translates in a linear direction. The body portion may comprise a cut-out portion which extends in a direction parallel to the longitudinal axis of the cap, and a portion of the sealing portion may be configured to extend through the cut-out portion. Engagement between the cut-out portion and the sealing portion may substantially restrict relative rotation between the body portion and the sealing portion, and simultaneously permit axial movement of the sealing portion relative to the body portion.

The seal may be formed under the application of a setting force and the first locking arrangement may be configured to maintain engagement of the sealing arrangement and the oil and/or gas well during application of the setting force. That is to say, when the first locking arrangement is in a locked position, the first locking arrangement may be configured to hold the sealing arrangement in engagement with the oil and/or gas well during application of the setting force. It will be appreciated that the locking arrangement may therefore be configured to apply a force which is such that the force required to disengage the first locking arrangement from the oil and/or gas well is greater than the setting force required to form the seal between the sealing portion and the surface of the oil and/or gas well.

The first locking arrangement may comprise a retaining member configured to retain the locking arrangement in an engaged state with the oil and/or gas well. The retaining member may be configured to restrict movement of the locking arrangement so as prevent separation of the sealing arrangement from the oil and/or gas well.

The first locking arrangement may comprise a latch configured to engage a locking portion of the oil and/or gas well. The locking portion of the oil and/or gas well may be a formation of the oil and/or gas well to which the latch may be engaged. In particular, the locking portion may be a radially extending protrusion of the oil and/or gas well. In some embodiments of the present invention, the latch may be supported by a body portion of the sealing arrangement. In particular, the latch may be supported within a groove of the body portion and the latch may be configured to pivot within the groove. The retaining member may be configured to retain the latch within the groove of the body portion. In embodiments of the present invention, the latch may comprise a downwardly depending tongue of the body portion configured to engage the locking portion.

The first locking arrangement may be configurable between a first state in which the latch is movable relative to the oil and/or gas well and a second state in which movement of the latch relative to the oil and/or gas well is restricted. For example, in the first state the retaining member may be configured to permit the latch to pivot within the groove of the body portion. In the second state the retaining member may be configured to engage a surface of the latch so as to substantially restrict movement of the latch relative to the oil and/or gas well. The retaining member may be a sleeve configured to substantially surround the latch so as to substantially restrict movement of the latch relative to the oil and/or gas well.

The sealing arrangement may further comprise a sealing element, the sealing element configured to engage the surface of the oil and/or gas well so as to substantially form the seal therebetween. That is to say, the sealing element may form the seal between the sealing portion and the surface of the oil and/or gas well. The sealing element may be configured to exert a biasing force against the surface of the oil and/or gas well so as to provide sealing contact between the sealing element and the surface of the oil and/or gas well. As such, the sealing element may be composed of a resiliently deformable material. The sealing element may comprise a generally u-shaped cross section. The sealing element may be supported by the sealing portion. For example, the sealing portion may be generally cylindrical, the sealing element may be generally annular, and the sealing element may be received by a circumferential groove of the sealing portion. Additionally or alternatively, the sealing portion may comprise a nose ring configured to retain the sealing element to the sealing portion. The nose ring may be threaded to the sealing portion.

The sealing element may be composed of metal. It will be appreciated that in harsh environments, such as sub-sea environments, a metal sealing element will be more durable and less likely to degrade than an alternative sealing element such as an elastomeric sealing element. As such, the sealing arrangement of embodiments of the present invention may last for long periods of time without the need for replacement or maintenance.

The sealing arrangement may further comprise a drive nut supported by the rotation portion. The drive nut may be configured to urge the sealing arrangement such that the sealing arrangement engages the surface of the oil and/or gas well. For example, the drive nut may urge against, or apply a force to, the sealing portion so as to cause the sealing portion to engage the surface of the oil and/or gas well. That is to say, the drive nut may urge the sealing portion to the sealed position. For example, the drive nut may be movable within a hollow interior of the sealing portion, and the hollow interior may comprise a first ledge configured to engage the drive nut. The first ledge may be positioned at a bottom of the hollow interior of the sealing portion. As such, when the drive nut engages the ledge of the sealing portion, the drive nut may urge against the first ledge to cause movement of the sealing portion with the drive nut towards the sealed position.

It will further be appreciated that the drive nut may be configured to urge the sealing portion away from the oil and/or gas well such that the sealing portion disengages the surface of the oil and/or gas well. For example, the hollow interior of the sealing portion may comprise a second ledge configured to engage the drive nut. The second ledge may be positioned at a top portion of the sealing portion. In particular, the second ledge may be defined by a plate or flange connected to the top portion of the sealing portion. As such, when the drive nut engages the second ledge of the sealing portion, the drive nut may urge against the second ledge to cause movement of the sealing portion away from the sealed position.

The sealing arrangement may further comprise a second keyway defined between the sealing portion and the drive nut, the second keyway may be configured to substantially restrict rotation of the drive nut relative to the sealing portion. For example, the second keyway may be defined between the drive nut and the sealing portion of the sealing arrangement. In particular, one of the drive nut or the sealing portion may define a longitudinal groove, and the other of the drive nut or the sealing portion may comprise a radially extending protrusion configured for receipt by the groove. As such, when the rotation portion is rotated, engagement between the radial protrusion of the drive nut and the longitudinal groove of the movable element may prevent relative rotation between the sealing portion and the drive nut. It will be appreciated that rotation of the rotation portion may produce linear movement of the drive nut. For example, the rotation portion may comprise a threaded exterior and the drive nut may comprise a threaded interior configured for receipt by the threaded exterior of the rotation portion. It will be appreciated that the rotation portion and the drive nut may be considered to define a lead screw configured to urge the movable element into or out of the sealed position.

The sealing arrangement may comprise a body portion configured to engage the oil and/or gas well. For example, during use, the body portion may be engaged to the oil and/or gas well via the first locking arrangement. The sealing portion may be movable relative to the body portion. In particular, the body portion may define a cylindrically hollow interior configured to receive the sealing portion.

The rotation portion may be supported for rotation by the body portion. It will be appreciated that relative rotation between the body portion and the rotation portion may be permitted, whilst axial movement of the rotation portion relative to the body portion is substantially prevented. The rotation portion may be supported for rotation about an axis generally parallel to a longitudinal axis of the sealing arrangement.

The body portion may further comprise a socket configured to receive a portion of a rotation tool. The socket may be arranged to react against the torque applied by the rotation tool so as to permit relative rotation between the rotation portion and the body portion. For example, the rotation tool may comprise an outer sleeve configured for receipt by the socket, and a driver configured to rotate within the outer sleeve and configured to impart rotational movement to the rotation portion of the cap. The socket prevents relative movement between the outer sleeve and the body portion, which therefore permits relative rotation between the rotation portion and the body portion.

The sealing arrangement may further comprise: a second locking arrangement; and the second locking arrangement may be configured to engage the sealing portion with the body portion. By engaging the sealing portion with the body portion, the second locking mechanism may substantially prevent movement between the body portion and the movable element. During use, when the sealing portion is in the sealed position and the second locking arrangement engages the sealing portion to the body portion, a resultant force exerted on the sealing portion by the pressure of a fluid contained in the oil and/or gas well may therefore be transferred from the sealing portion to the body portion via the engagement of the second locking mechanism. However, because the first locking arrangement engages the body portion to the oil and/or gas well, the resultant force due to the pressure of the fluid within the oil and/or gas well may be transferred to the oil and/or gas well itself.

It will further be appreciated that because the second locking arrangement engages the sealing portion with the body portion, the resultant force due to the pressure of the fluid within the oil and/or gas well is not transferred through any components of the sealing arrangement configured to urge the sealing portion into the sealed position such as the drive nut or the rotation portion. It will be appreciated that by directing the resultant force due to the pressure of the fluid in the oil and/or gas well away from the drive nut and the rotation portion durability of the sealing arrangement may be improved.

The sealing arrangement may comprise a lock ring configured to engage the sealing portion so as to substantially restrict relative movement between the sealing arrangement and the surface of the oil and/or gas well. The lock ring may engage the sealing portion and the body portion so as to restrict movement between the sealing portion and the body portion in a linear direction. For example, the lock ring may be partially received within a groove of the sealing portion and partially received within a groove of the body portion. The lock ring may be resiliently deformable such that the lock ring may be selectively disengaged from the groove of the body portion by deformation of the lock ring. It will be understood that the term "resiliently deformable" is intended to mean that the lock ring may deform in response to the application of a deformation force, however once the deformation force is removed the lock ring will return to an undeformed state. It will be appreciated that in this sense "resiliently deformable" is intended to refer to elastic deformation and not plastic (or permanent) deformation.

The second locking arrangement may further comprise a drive pin configured to substantially restrict deformation of the lock ring and thereby prevent disengagement of the lock ring from the groove of the body portion. The drive nut may be configured to engage the drive pin so as to substantially restrict deformation of the lock ring, and thereby substantially restrict relative movement between the sealing portion and the body portion. As such, when the drive nut is engaged with the drive pin, disengagement of the lock ring from the formation of the sealing arrangement may be prevented.

The sealing arrangement may comprise a first visual indicator configured to indicate a locked position of the second locking arrangement. The first visual indicator may comprise a first marker connected to the drive nut and a second marker connected to the sealing portion. The first marker of the first visual indicator may be connected to the drive nut via an arm. During use, when the drive nut is in the locked position, the first marker of the first visual indicator may be positioned adjacent the second marker to indicate that the drive nut is in the locked position. It will be appreciated that when the first marker of the first visual indicator is not adjacent the second marker of the first visual indicator the drive nut may be considered to be indicated as not in a locked position.

It will be appreciated that when the second locking arrangement is in a locked position, relative movement between the sealing portion and the body portion is substantially restricted. As such, the locked position of the second locking arrangement may be defined by engagement between the drive nut and the drive pin. It will be appreciated that the second locking arrangement may comprise two or more lock rings each having an associated drive pin. As such, the second locking arrangement may define two or more locked positions.

Rotation of the rotation portion in a first direction may cause the sealing arrangement to engage a surface of the oil and/or gas well and rotation of the rotation portion in a second direction substantially opposite the first direction may cause the sealing arrangement to disengage the surface of the oil and/or gas well. For example, the drive nut may be configured to urge the sealing arrangement such that the sealing arrangement disengages the surface of the oil and/or gas well. In particular, the drive nut may be configured to engage the sealing portion to urge the sealing portion away from the sealed position when the rotation portion is rotated in the second direction. It will be appreciated that when the sealing arrangement disengages the oil and/or gas well, the sealing arrangement does not form a seal against the surface of the oil and/or gas well.

The rotation portion may be a shaft. The rotation portion may comprise an input portion configured to receive a rotational input. For example, the input portion may comprise a torque key or a torque receptacle configured to engage a corresponding torque key or torque receptacle of a rotation tool.

The sealing arrangement may further comprise a second visual indicator configured to indicate a sealed position of the sealing arrangement. For example, the second visual indicator may comprise a first marker connected to the body portion and second marker connected to the sealing portion. The first marker of the second visual indicator may be a radially extending protrusion of the body portion. During use, when the sealing portion is in the sealed position, the first marker of the second visual indicator may be positioned adjacent the second marker of the second visual indicator. It will be appreciated that when the first marker of the second visual indicator is not positioned adjacent the second marker of the second visual indicator, the sealing portion is not in the sealed position.

According to a second aspect of embodiments of the invention there is provided a method of forming a seal using a sealing arrangement according to any preceding claim, wherein the method comprises rotating the rotation portion so as to cause the sealing arrangement to engage the surface of the oil and/or gas well.

According to a third aspect of embodiments of the invention there is provided an oil and/or gas well, comprising: a wellbore; a treehead in fluid flow communication with the wellbore; and a sealing arrangement, the sealing arrangement comprising: a rotation portion; wherein rotation of the rotation portion causes the sealing arrangement to engage a surface of the oil and/or gas well so as to substantially form a seal therebetween.

Aspects of embodiments of the invention may be combined such that features described in the context of one aspect of embodiments of the invention may be implemented in others of the aspects of embodiments of the invention.

BRIEF DESCRIPTION OF THE DRAWINGS

A detailed description of embodiments of the invention will now be described with reference to the accompanying drawings, in which.

DETAILED DESCRIPTION

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application.

Figure 1:
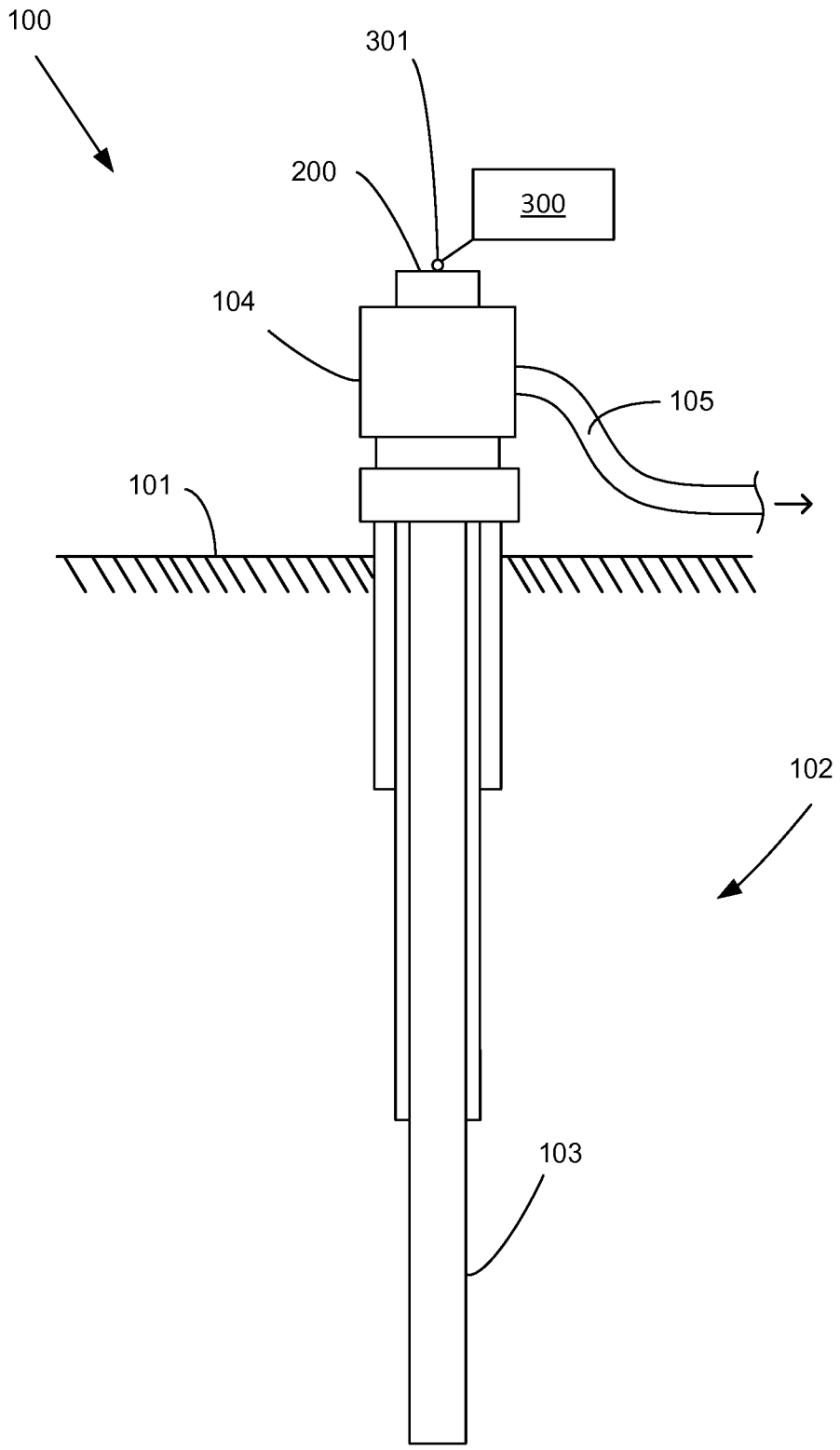
FIG. 1 is a schematic side view of a well.

FIG. 1 shows a well 100 for extracting oil or gas from within the Earth's crust. The well 100 is a sub-sea well located on a seabed 101. The well 100 comprises a wellbore 102 containing a plurality of casings sunk into the Earth's crust configured to extract oil or gas from oil or gas producing formations of the Earth's crust. The wellbore 102 comprises a production tubing 103 which is configured to carry extracted oil or gas upwards through the wellbore 102 to a treehead 104 of the well 100. The treehead 104 is connected to a pipeline 105 configured to carry oil or gas from the treehead 104 to a downstream collection and/or processing facility. A cap 200 is fitted to the well 100 above the treehead 104 by an ROV 300. The ROV 300 comprises a tool 301 configured to engage with the cap 200 to cause the cap 200 to be fitted to the well 100. Although not shown in the figure, it will be appreciated that the well 100 may further comprise a blowout preventer which may be fitted to or form part of the treehead 104.

Figure 2:
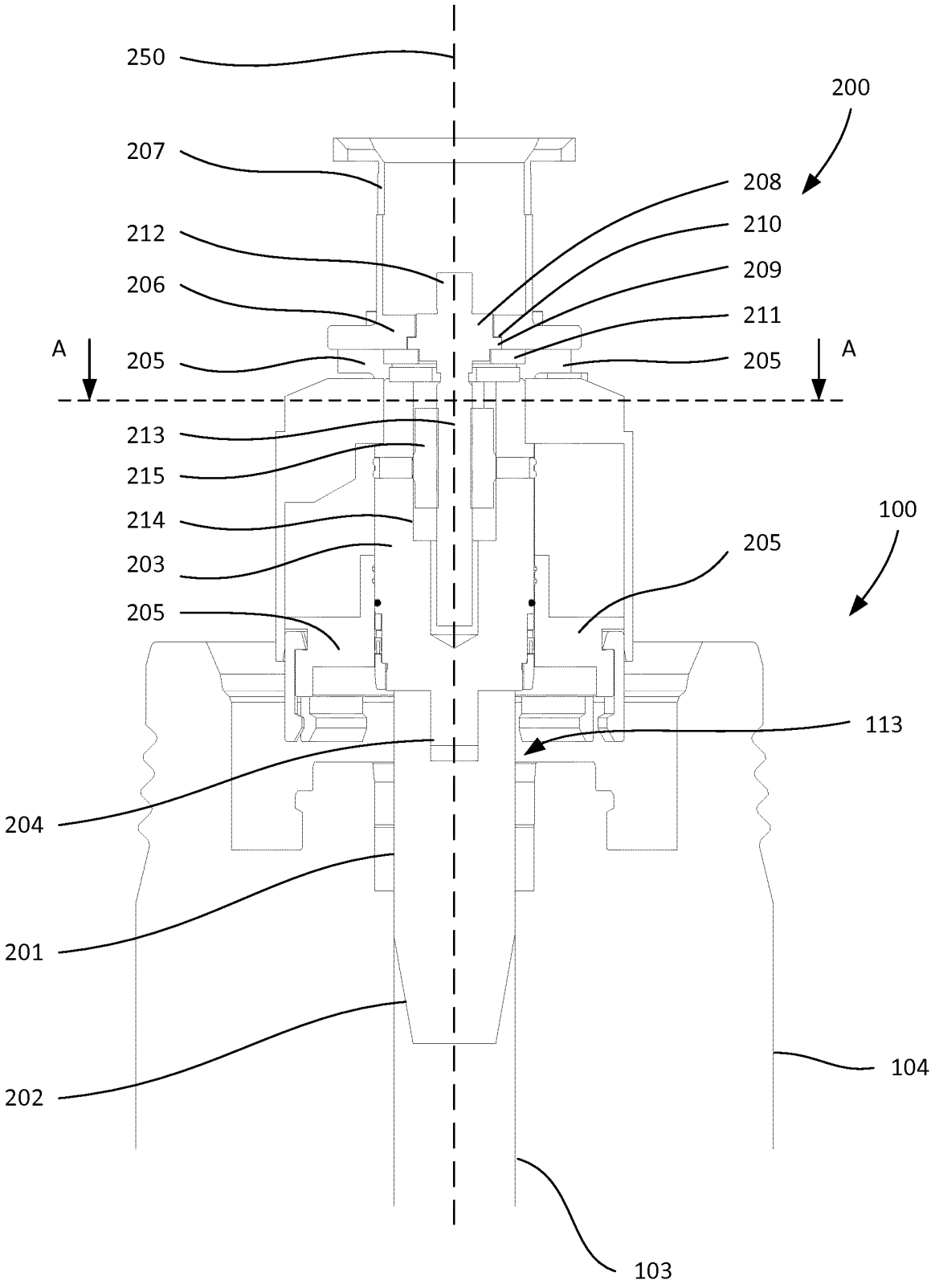
FIG. 2 is a cross-sectional side view of a treehead and cap in an unassembled state.

FIG. 2 shows a cross-sectional side view of an upper portion of the treehead 104 of the well 100 and the cap 200 in an unassembled state. It will be appreciated that although the cap 200 is fitted to the well 100 by the ROV 300, the ROV 300 has been omitted from FIGS. 2 to 13 for clarity. The treehead 104 defines an opening 113 of the production tubing 103, into which a running tool (not shown) may be inserted for maintenance or upgrade work to the well 100. The treehead 104 further comprises a series of valves (not shown) positioned within the production tubing 103 below the opening 113, which are configured to prevent oil or gas extracted from the well 100 from leaking into the surrounding environment when the cap 200 is not fitted to the treehead 104. When a running tool is inserted into the opening 113, the valves of the treehead 104 may be opened to permit the running tool to travel past the valves and into the well 100. The cap 200 is positioned by the ROV 300 such that a longitudinal axis 250 of the cap 200 is collinear with a longitudinal axis of the treehead 104.

The cap 200 comprises a production stab 201 which is generally cylindrical and is configured for receipt by the opening 113 of the production tubing 103, the opening 113 being correspondingly cylindrical so as to receive the production stab 201. A lower portion of the production stab 201 defines a tapered surface 202 configured to guide the cap 200 into position when the production stab 201 is inserted into the opening 113. The production stab 201 is fixed to a sealing portion 203 such that relative movement between the production stab 201 and the sealing portion 203 is substantially prevented. The production stab 201 may be fixed to the sealing portion 203 by any suitable means, such as for example via a threaded connector 204. Alternatively, the production stab 201 and the sealing portion 203 may be integrally formed.

The cap 200 further comprises a generally tubular main body 205 which defines a cylindrically hollow interior within which the sealing portion 203 is movable. A header 206 is connected to the main body 205 at an upper end of the main body 205. It will be appreciated that the header 206 may be connected to the main body 205 by any suitable means, such as for example by bolting. The header 206 is generally tubular, and defines a socket 207 configured to receive the tool 301 of the ROV 300. A cylindrical shaft 208 extends downwardly from the header 206, and is supported for rotation by a radially extending flange 209 of the shaft 208 positioned between a radially extending ledge 210 of the header 206 and an annular plate 211 connected to an underside of the header 206. It will be appreciated that the annular plate 211 may be connected to the header 206 by any suitable means, such as, for example, by bolts. It will be appreciated that the main body 205, header 206 and annular plate 211 may be considered to define a body portion of the cap 200.

The shaft 208 comprises an input portion 212 positioned above the flange 209 of the shaft 208 and below the socket 207. The input portion 212 is configured to engage with the tool 301 of the ROV 300 so as to transfer a torque applied to the input portion 212 by the tool 301 to the shaft 208 and thereby cause rotation of the shaft 208 relative to the header 206 and the main body 205. The input portion 212 defines a driver configured for receipt by a corresponding socket of the tool 301; however it will be appreciated that the input portion may comprise any suitable element configured to receive a torque applied by the tool 301. The shaft 208 further comprises a lower portion 213 positioned below the flange 209, which extends into a cylindrically hollow interior 214 of the sealing portion 203. A drive nut 215 is supported for linear movement along the lower portion 213 of the shaft 208, the drive nut 215 defining a threaded interior configured to receive a threaded exterior of the lower portion 213 of the shaft 208.

It will be appreciated that the production stab 201, sealing portion 203, shaft 208, treehead 104, and header 206 are composed of a metal such as for example carbon steel, low alloy steel, corrosion resistant nickel alloy, or stainless steel. Additionally or alternatively, the production stab 201 may be composed of a softer material than the treehead 104, such as, for example, plastic. It will be appreciated that because the production stab 201 may be composed of a softer material than the treehead 104, the likelihood of the treehead 104 being damaged by the production stab 201 during installation of the cap 200 is reduced. It will further be appreciated that the production stab 201, sealing portion 203, shaft 208, treehead 104, and header 206 may be composed of different materials to one another.

Figure 3:
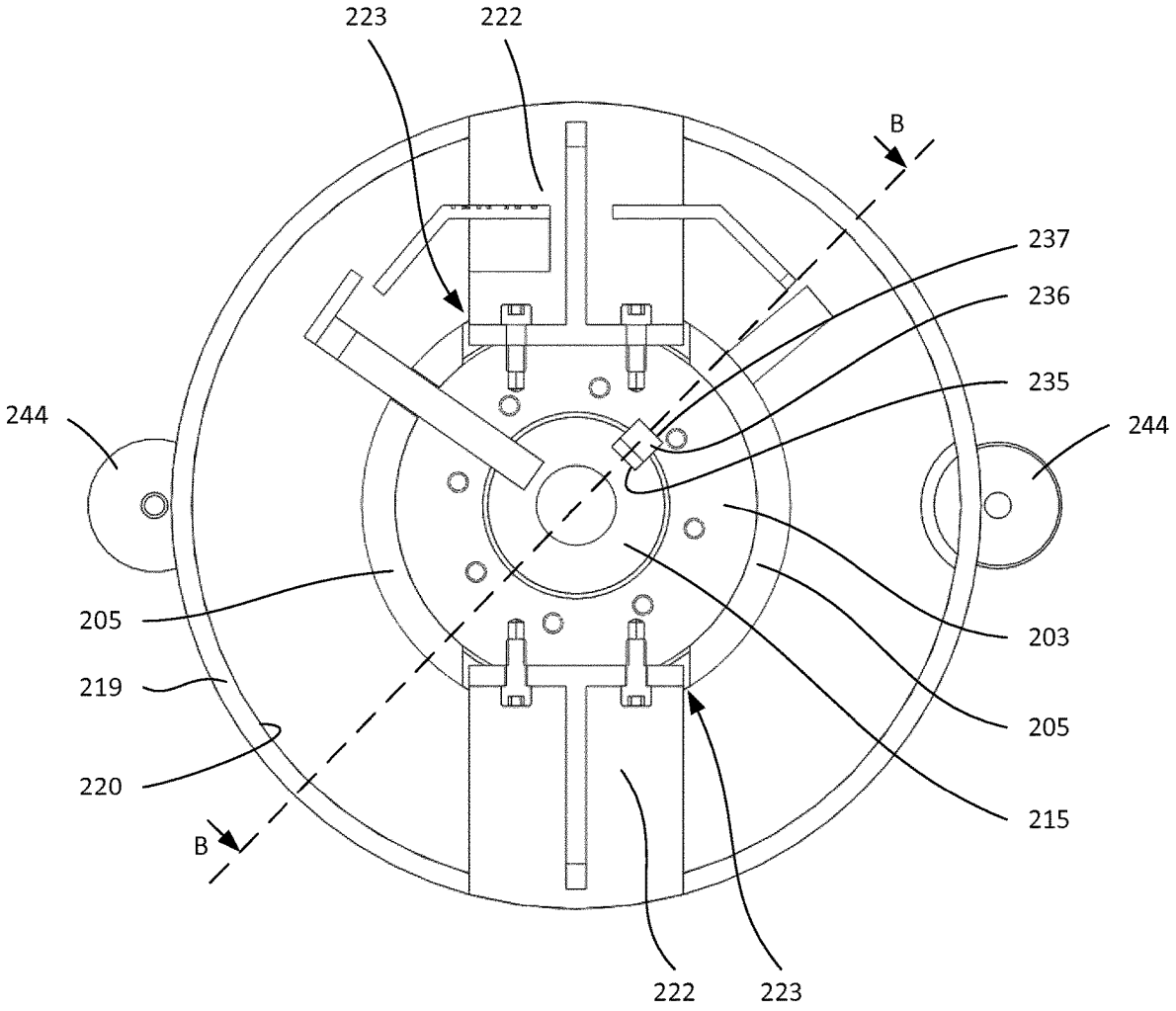
FIG. 3 is a cross-sectional plan view of the cap taken along section A-A of FIG. 2.

FIG. 3 shows a cross section of the cap 200 taken along section A-A of FIG. 2. The drive nut 215 is keyed to the sealing portion 203 via a keyway comprising a longitudinally extending groove 235 of the drive nut 215 within which a key 236 is partially received. The key 236 is held by the sealing portion 203 within a groove 237 of the sealing portion 203. The cap 200 further comprises a sleeve 219 which substantially surrounds the sealing portion 203 and the main body 205. The sleeve is composed of metal, such as for example carbon steel or low alloy steel. The sleeve 219 comprises a generally tubular portion defining an inner surface 220 that is generally cylindrical, and a bridge 222 which extends from the generally tubular portion of the sleeve 219 to the sealing portion 203 where it is fixedly secured to the sealing portion 203 by bolting. The main body 205 defines a pair of cut-out portions 223 located on opposite sides of the sealing portion 203, which permit the bridge 222 of the sleeve 219 to extend into the interior of the main body 205 in order to secure the sleeve 219 to the sealing portion 203. The cut-outs 223 act as a keyway between the main body 205 and the sealing portion 203 that substantially prevents relative rotation between the main body 205 and the sealing portion 203. It will be appreciated that bridge 222 of the sleeve 219 may be fixed to the sealing portion 203 by alternative means, such as, for example, by welding.

As the shaft 208 is rotated, the key 236 engages the longitudinally extending groove 235 of the drive nut 215 so as to substantially prevent relative rotation between the drive nut 215 and the sealing portion 203. Rotation of the shaft 208 therefore causes the sealing portion 203 to twist such that the bridge 222 of the sleeve 219 engages the cut-outs 223 so as to prevent relative rotation between the sleeve 219 and the main body 205. Therefore, in response to the rotation of the shaft 208, the drive nut 215 moves in a linear direction along the longitudinal axis 250 of the cap 200. As such, the shaft 208, drive nut 215, sealing portion 203 and sleeve 219 may be considered to define a lead screw.

With reference to FIGS. 2 and 3, it will be appreciated that rotation of the shaft 208 in a first direction will cause the drive nut 215 to move axially downwards along the longitudinal axis 250 of the cap 200, whilst rotation of the shaft 208 in a second substantially opposite direction will cause the drive nut 215 to move axially upwards along the longitudinal axis 250.

Figure 4:
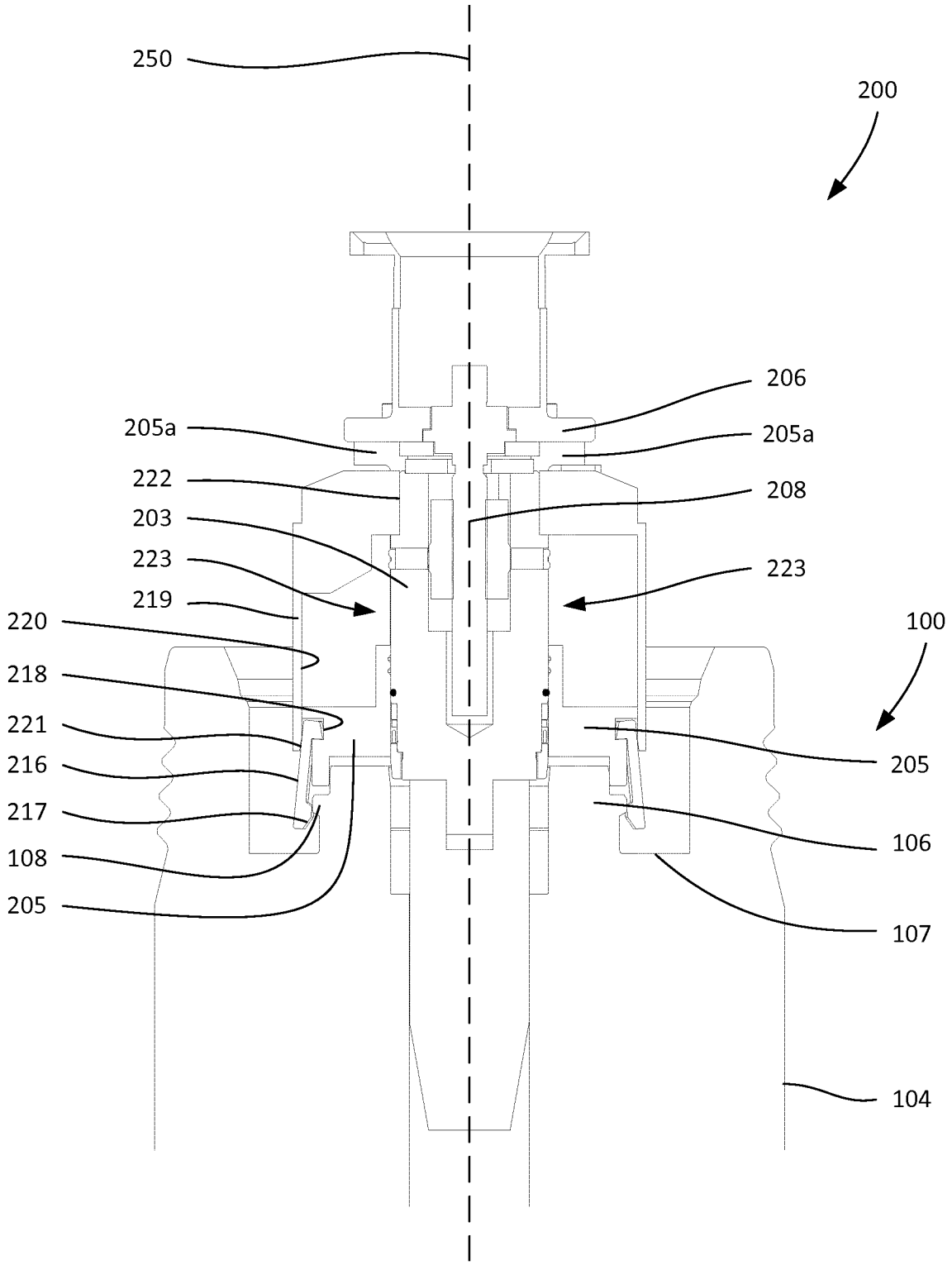
FIG. 4 is a cross-sectional side view of the treehead and cap in a partially engaged state.

FIG. 4 shows the cap 200 being lowered into position over the treehead 104. Lowering of the cap 200 is achieved by controlling the position of the tool 301 of the ROV 300, and by using the ROV's 300 propulsion system. The treehead 104 defines a generally cylindrical connection portion 106 which extends axially upwards from an end face 107 of the treehead 104. The cap 200 comprises a plurality of latches 216 configured to engage a radially extending latch portion 108 defined by the connection portion 106 of the treehead 104. The latches 216 comprise a tapered surface 217 positioned at a lower end of each of the latches which is configured to guide the latches 216 into a tilted position so that the latches 216 may pass over the latch portion 108 of the treehead 104. An upper end of each of the latches 216 is supported by an inwardly extending cylindrical groove 218 of the main body 205. The latches 216 are prevented from falling out of the groove 218 by the inner surface 220 of the sleeve 219. The sleeve 219 further comprises a tapered portion 221 positioned at a leading edge of the sleeve 219 which is configured to permit tilting of the latches 216.

It will be appreciated that during assembly of the cap 200 (for example during manufacture of the cap 200 prior to installation), the header 206 is initially not secured to the main body 205 and the cut-outs 223 are therefore open at an upper end 205*a* of the main body 205. As such, the sleeve 219 and the sealing portion 203 are first secured to one another via the bridge 222 of the sleeve 219, and the sealing portion 203 is then inserted into the interior of the main body 205 such that the bridge 222 of the sleeve 219 passes through the open end of the cut-outs 223. Once the bridge 222 of the sleeve 219 is fully received within the cut-outs 223, the header 206 is secured to the main body 205.

Figure 5:
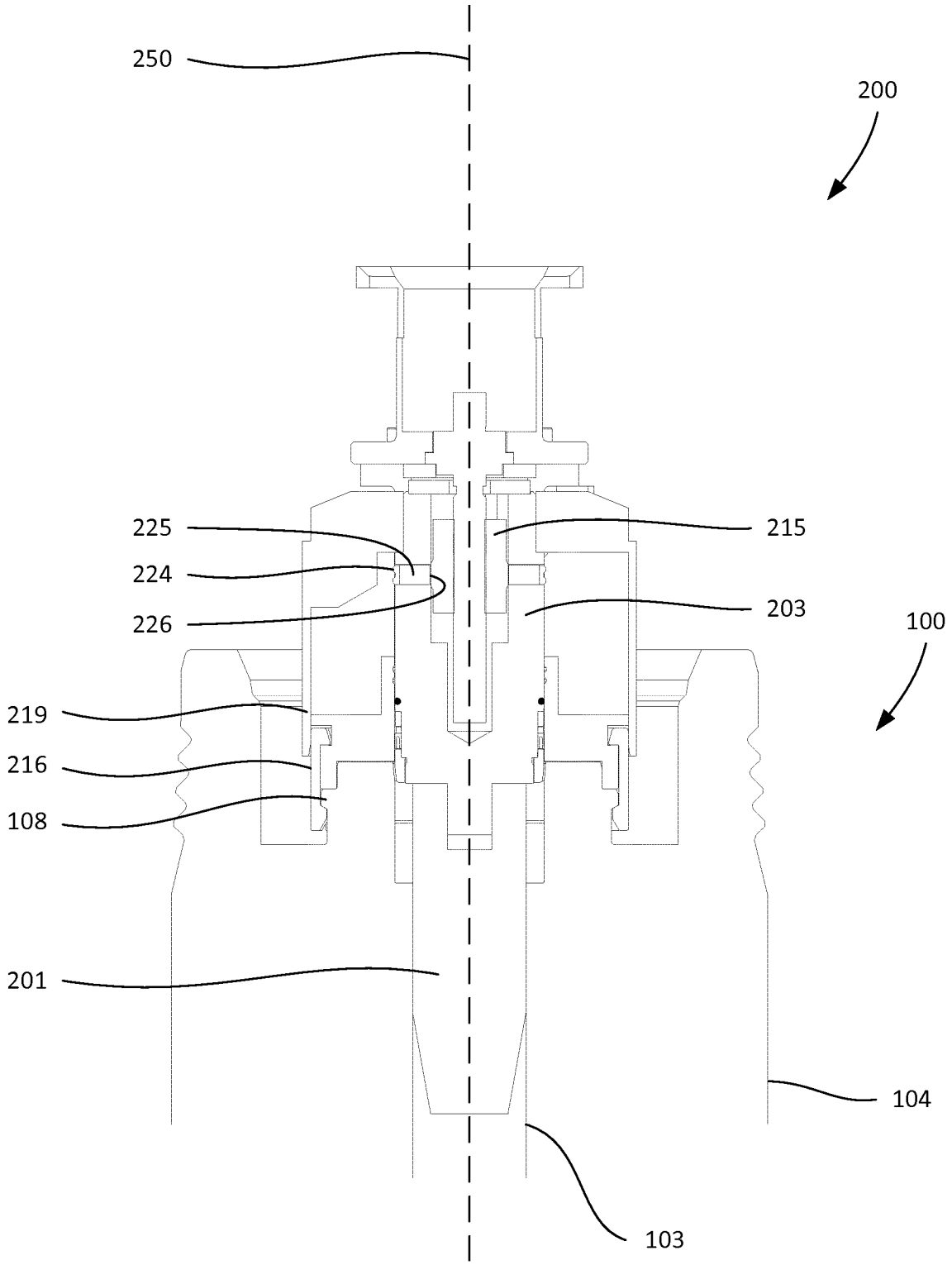
FIG. 5 is a cross-sectional side view of the treehead and cap in which the cap is landed upon the treehead in an unsealed position.

FIG. 5 shows the cap 200 fully lowered into position over the treehead 104 such that the latches 216 are fully engaged with the latch portion 108 of the treehead 104. Although the cap 200 is landed upon the treehead 104, the sealing portion 203 is not positioned in a sealed position against the treehead 104. As such, in the operating state shown in FIG. 5, the cap 200 does not act to seal against the treehead 104. It will be understood that any such position of the sealing portion 203 in which the sealing portion 203 is not in a sealed position may be said to define an unsealed position of the sealing portion 203. It will be appreciated that the movement of the latches 216 allows the cap 200 to be positioned into the fully lowered position shown in FIG. 5 such that the cap 200 is engaged with the treehead 104 without requiring substantial downward force to be applied to the cap 200.

The cap 200 further comprises a lock ring 224 which is positioned within an inwardly extending circumferential groove of the sealing portion 203. The sealing portion 203 further comprises a plurality of radially extending conduits, each of which comprises a moveable drive pin 225 configured to contact the lock ring 224 by a radially outermost end. The drive nut 215 defines a cam surface 226 which extends from the drive nut 215 in a radially outward direction to contact a radially innermost end of the drive pins 225. The lock ring 224 is generally c-shaped and is composed of a resiliently deformable material such as for example high strength low alloy steel, or beryllium copper alloy. The lock ring 224 may therefore be deformed such that the diameter of the lock ring 224 becomes temporarily narrowed in response to a deformation force resulting from contact with the main body 205. However, it will be appreciated that when the cam surface 226 contacts the drive pins 225, the drive pins 225 substantially prevent such deformation of the lock ring 224. Operation of the lock ring 224 is described in further detail below with reference to FIGS. 6 and 7.

Figure 6:
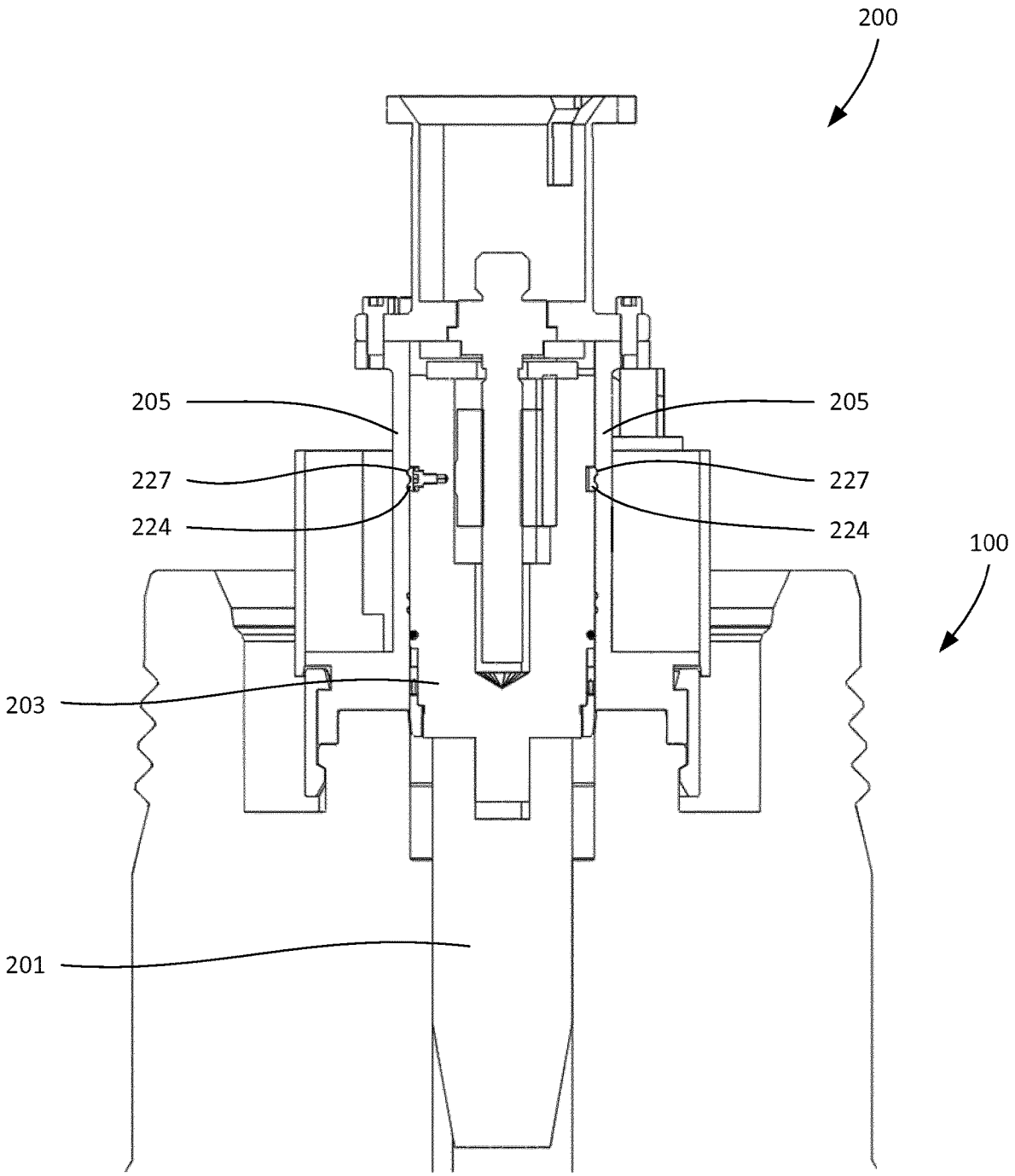
FIG. 6 is a cross-sectional side view of the treehead and cap in which the cap is landed upon the treehead in an unsealed position taken along section B-B of FIG. 3.

FIG. 6 shows a cross-sectional view of the cap 200 taken along the section B-B of FIG. 3, in which the cap 200 is fully lowered into position over the treehead 104, corresponding to the position shown in FIG. 5, in which the lock ring is shown in further detail. The lock ring 224 comprises a radially outermost face which defines a locking profile. The locking profile of the lock ring 224 is received within a first locking groove 227 of the main body 205 which defines a corresponding profile to the locking profile of the lock ring 224. It will be appreciated that when the cam surface 226 of the drive nut 215 is in contact with the drive pins 225 (as shown in FIG. 5) the lock ring 224 is prevented from deforming. As such, the lock ring is unable to move relative to the first locking groove 227 of the main body 205 and therefore the axial positions of the production stab 201, sealing portion 203, and sleeve 219 relative to the main body 205 are fixed. It will be appreciated that because the lock ring 224 is fixed within the first locking groove 227, when the production stab 201 is inserted into the treehead 104 frictional contact between the production stab 201 and the production tubing 103 does not result in movement of the production stab 201 relative to the main body 205.

Figure 7:
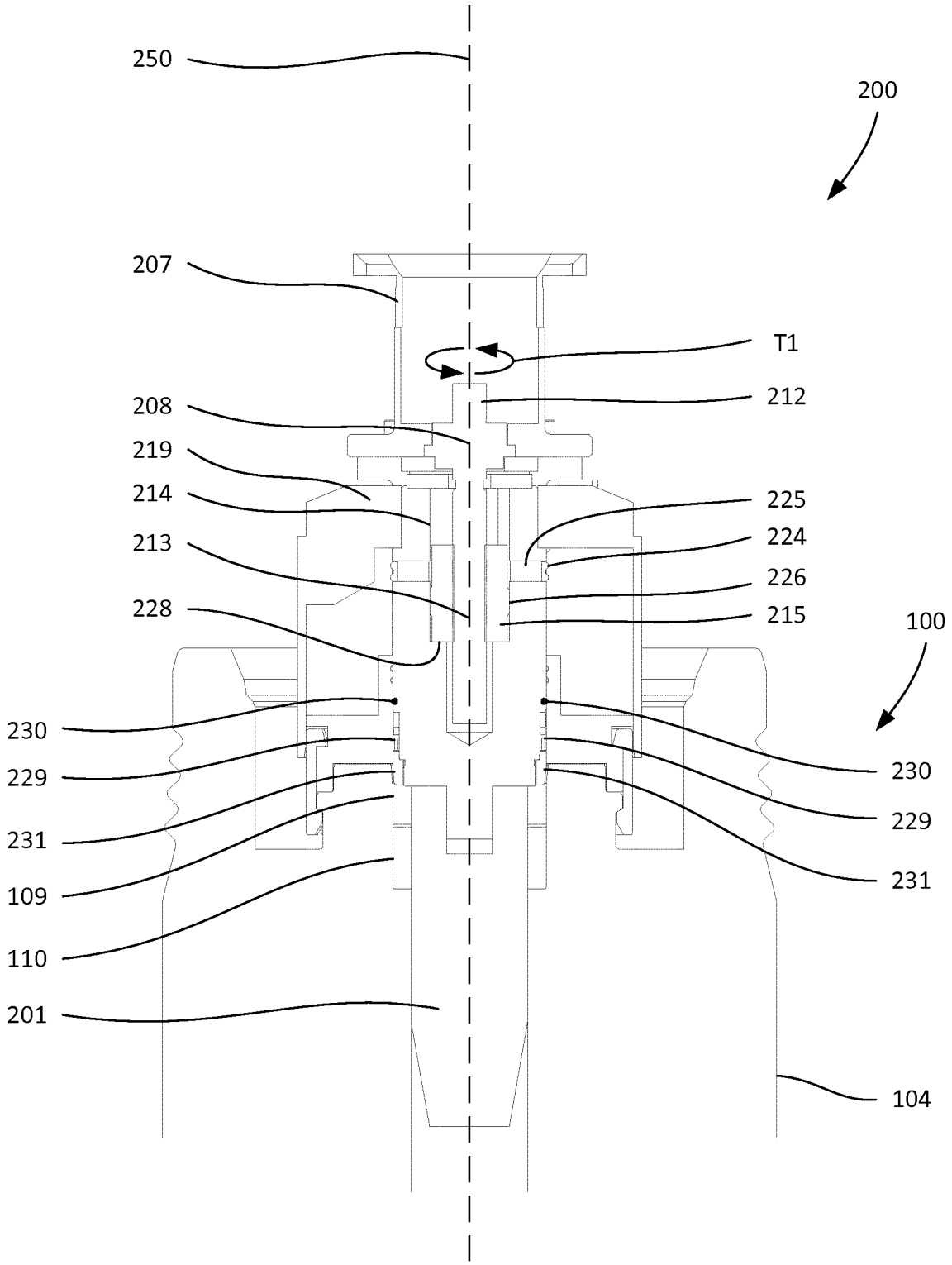
FIG. 7 is a cross-sectional side view of the treehead and cap in which the cap is landed upon the treehead in an unsealed position and in which a drive nut is urged against a sealing portion in a downwards direction.

FIG. 7 shows an operating state of the cap 200 in which the drive nut 215 has been moved axially downwards along the lower portion 213 of the shaft 208 by the application of an input torque T1 in a first direction upon the input portion 212 by the tool 301 of the ROV 300. It will be appreciated that because a portion of the tool 301 of the ROV 300 is received by the socket 207, the socket 207 is arranged such that relative rotation between the header 206 and the ROV 300 is prevented. In particular, the socket 207 engages with the ROV 300 such that the socket 207 reacts against the application of the input torque T1 upon the input portion 212 of the shaft 208. For example, the tool 301 may comprise an outer sleeve defining a bayonet portion configured for receipt by the socket 207, and may further comprise an inner shaft rotatable within the outer sleeve and configured to impart the input torque T1 upon the input portion 212 of the shaft 208 of the cap 200. It will be appreciated that the socket 207 therefore aids in the application of the input torque T1 on the input portion 212 of the shaft 208.

The input torque T1 results in rotation of the shaft 208 in the first direction so as to cause downwards movement of the drive nut 215 along the longitudinal axis 250. Continued rotation of the shaft 208 in the first direction results in contact between the drive nut 215 and an annular ledge 228 of the sealing portion 203 formed in the interior 214 of the sealing portion 203. Due to the application of the input torque T1, the drive nut 215 exerts a downward force upon the annular ledge 228. Because the nut 215 has moved along the shaft 208, the cam surface 226 is no longer in contact with the drive pins 225. Urging of the nut 215 against the annular ledge 228 of the sealing portion 203 therefore causes the lock ring 224 to resiliently deform into the circumferential groove of the sealing portion 203 and to slide out of the first locking groove 207 of the main body 205. As such, the sealing portion 203 is no longer fixed to the body portion 205, and therefore urging of the drive nut 215 against the annular ledge 228 of the sealing portion 203 causes downwards movement of the sealing portion 203 along the longitudinal axis 250. It will be appreciated that because the sleeve 219 and the production stab 201 are fixed to the sealing portion 203, in response to the urging of the drive nut 215 against the sealing portion 203 the sleeve 219 and the production stab 201 will also move downwards along the longitudinal axis 250 relative to the main body 205. As such, the sealing portion 203, the production stab 201 and the sleeve 219 may be considered to define a movable element which is movable relative to the main body 205 (or body portion). It will further be appreciated that the cut-outs 223 of the body portion 205 are elongate in shape, so as to permit the bridge of the sleeve 219 to move along the longitudinal axis 250. That is to say, the cut-outs 223 (not shown in FIG. 7) form a slot within which the bridge 222 of the sleeve 219 is movable.

As the drive nut 215 is urged against the annular ledge 228 of the sealing portion 203, the sealing portion 203 is moved downwards such that it is received within a hollow interior of the treehead 104 defined by a first inner surface 109 and a second inner surface 110 of the treehead 104. The first inner surface 109 and second inner surface 110 are generally cylindrical, however the first inner surface 109 defines a wider diameter than the second inner surface 110. Both the first and second inner surfaces 109, 110 define wider diameters than the production tubing 103. However, it will be appreciated that in some embodiments of the invention the first and second inner surfaces 109, 110 may have substantially the same diameter as the production tubing 103 such that the first and second inner surfaces 109, 110 are surfaces of the production tubing 103.

The sealing portion 203 further comprises a first sealing element 229 and a second sealing element 230 which are configured to contact the second sealing surface 110 of the treehead 104 so as to substantially form a seal therebetween (described below). The first sealing element 229 is generally annular in shape and comprises a u-shaped cross section. The first sealing element 229 is composed of metal such as for example corrosion-resistant nickel alloy or stainless steel, however it will be appreciated that the first sealing element 229 may be composed of any material with at least some elastic properties, such as an elastomer. The first sealing element 229 is positioned at a lower end of the sealing portion 203 and is retained upon the sealing portion 203 by a nose ring 231 which is threaded onto the lower end of the sealing portion 203. The second sealing element 230 is received within a circumferential groove of the sealing portion 203 and is composed of an elastomeric material such as for example hydrogenated nitrile butadiene rubber, however it will be appreciated that the second sealing element 230 may be composed of a different material, such as metal. It will be appreciated that the sealing portion 203 may comprise any number of sealing elements configured to substantially form a seal between the sealing portion 203 and the second inner surface 110 of the treehead 104.

Figure 8:
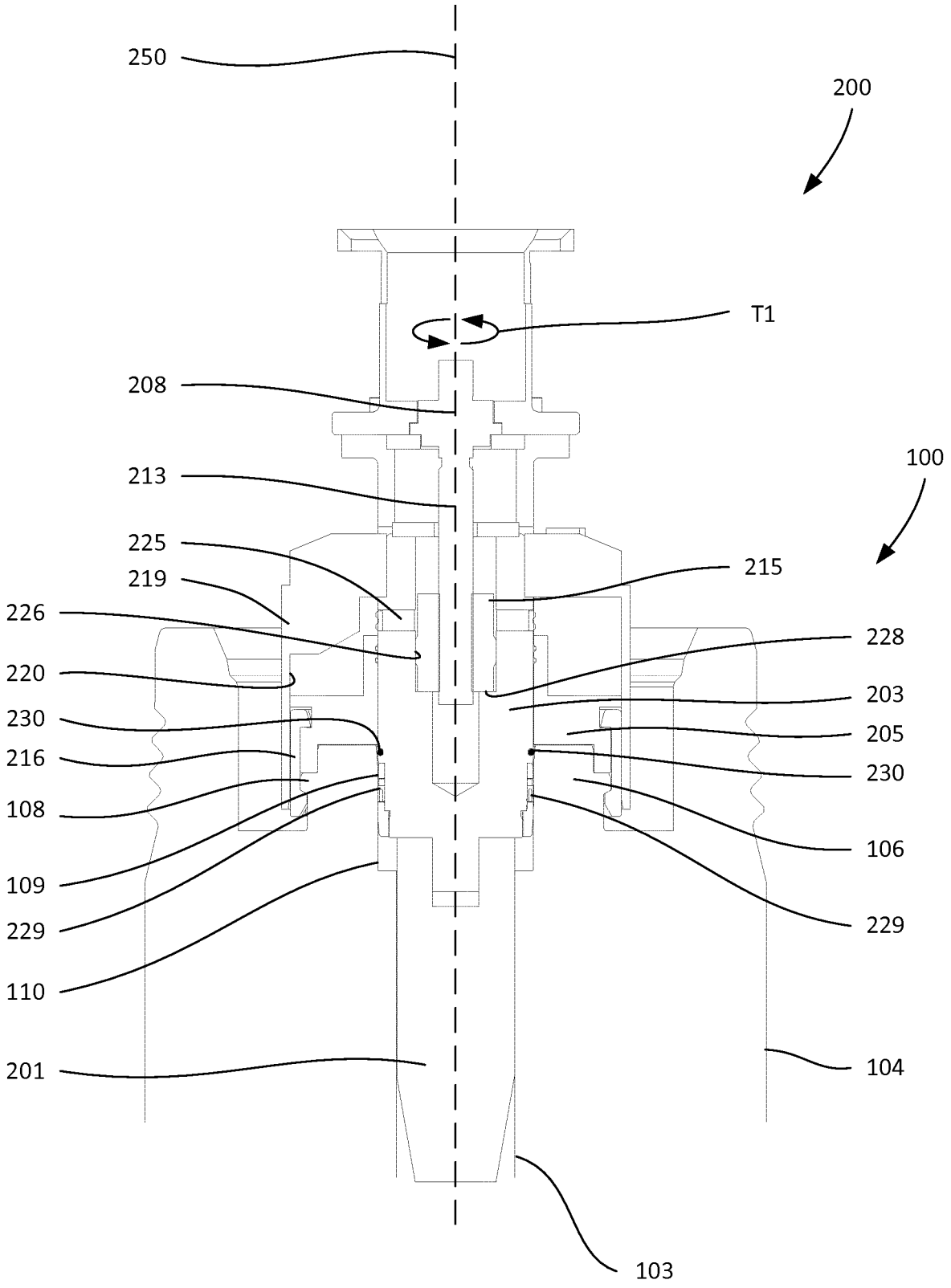
FIG. 8 is a cross-sectional side view of the treehead and cap in which the cap is locked to the treehead in an unsealed position.

FIG. 8 shows a cross-sectional view of the cap 200 in which the drive nut 215 has moved downwards along the lower portion 213 of the shaft 208 in response to the application of the input torque T1. The drive nut 215 has urged the production stab 201, sealing portion 203, and sleeve 219 downwards along the lower portion 213 of the shaft 208. As such, the production stab 201 has moved further into the production tubing 103, and the sealing portion 203 has moved downwards into the interior of the treehead 104 defined by the first inner surface 109 of the treehead 104. Because the diameter of the first inner surface 109 is wider than the diameter of the second inner surface 110, frictional resistance to movement of the first and second sealing elements 229, 230 over the first inner surface 109 is either not present or is relatively small. As such, the latches 216 and the weight of the cap 200 prevent the main body 205 from lifting away from the treehead 104 as the sealing portion 203 travels over the first inner surface 109 of the treehead 104.

In response to the downwards movement of the drive nut 215, the sleeve 219 moves downwards such that the latches 216 are substantially surrounded by the inner surface 220 of the sleeve 219. The sleeve 219 substantially prevents the latches 216 from tilting outwards, and therefore the latches 216 are prevented from disengaging from the latch portion 108 of the treehead 104. As such, the cap 200 is locked to the connection portion 106 of the treehead 104 such that movement of the main body 205 of the cap 200 relative to the treehead 104 is substantially prevented. It will be appreciated that because the first sealing element 229 is composed of metal, movement of the first sealing element 229 relative to the second inner surface 110 of the treehead 104 is subject to high frictional resistance. As such, because the sleeve 219 prevents the latches 216 from disengaging from the latch portion 108 of the treehead 104, the main body 205 is prevented from lifting away from the treehead 104 as the first sealing element 229 contacts the second inner surface 110 of the treehead 104. That is to say, the sleeve 219 and latches 216 react against the high frictional resistance caused by contact between the first sealing element 229 and the second inner surface 210 of the treehead 104, and thus permit further movement of the sealing portion 203 into the interior of the treehead 104 bounded by the second inner surface 110.

It will be appreciated that the lead screw mechanism defined by the shaft 208 and the drive nut 215 affords a mechanical advantage which is able to impart a relatively high linear force upon the annular ledge 228 of the sealing portion 203 based upon a comparatively low input torque T1. The linear force applied by the drive nut 215 upon the annular ledge 228 of the sealing portion 203 is sufficient to overcome the frictional resistance to movement of the sealing portion 203 caused by contact between the first and second sealing elements 229, 230 and the second inner surface 110 of the treehead 104. This frictional resistance is typically high where either the first or second sealing elements 229, 230 are composed of metal. A thread pitch and thread pitch angle between the exterior thread of the lower portion 213 of the shaft 208 and the interior thread of the drive nut 215 may be selected which produces sufficient linear force upon the drive nut 215 to overcome the frictional resistance of the sealing elements 229, 230, as would be understood by a person skilled in the art.

It will be appreciated that the fluid positioned below the production stab 201 within the production tubing 103 is displaced by the insertion of the production stab 201 into the treehead 104. The displaced fluid is vented to the surrounding environment from the production tubing 103 via valves and/or ports (not shown) of the treehead 104 which are in fluid communication with the production tubing 103. It will therefore be appreciated that hydraulic resistance to the insertion of the production stab 201 into the production tubing 103 is minimised.

It can be seen from FIG. 8 that although the drive nut 215 has moved further along the shaft 208, an upper portion of the drive nut 215 (i.e. a portion of the drive nut 215 above the cam surface 226) is positioned behind the drive pins 225 to retain the drive pins 225 within the conduits of the sealing portion 203.

Figure 9:
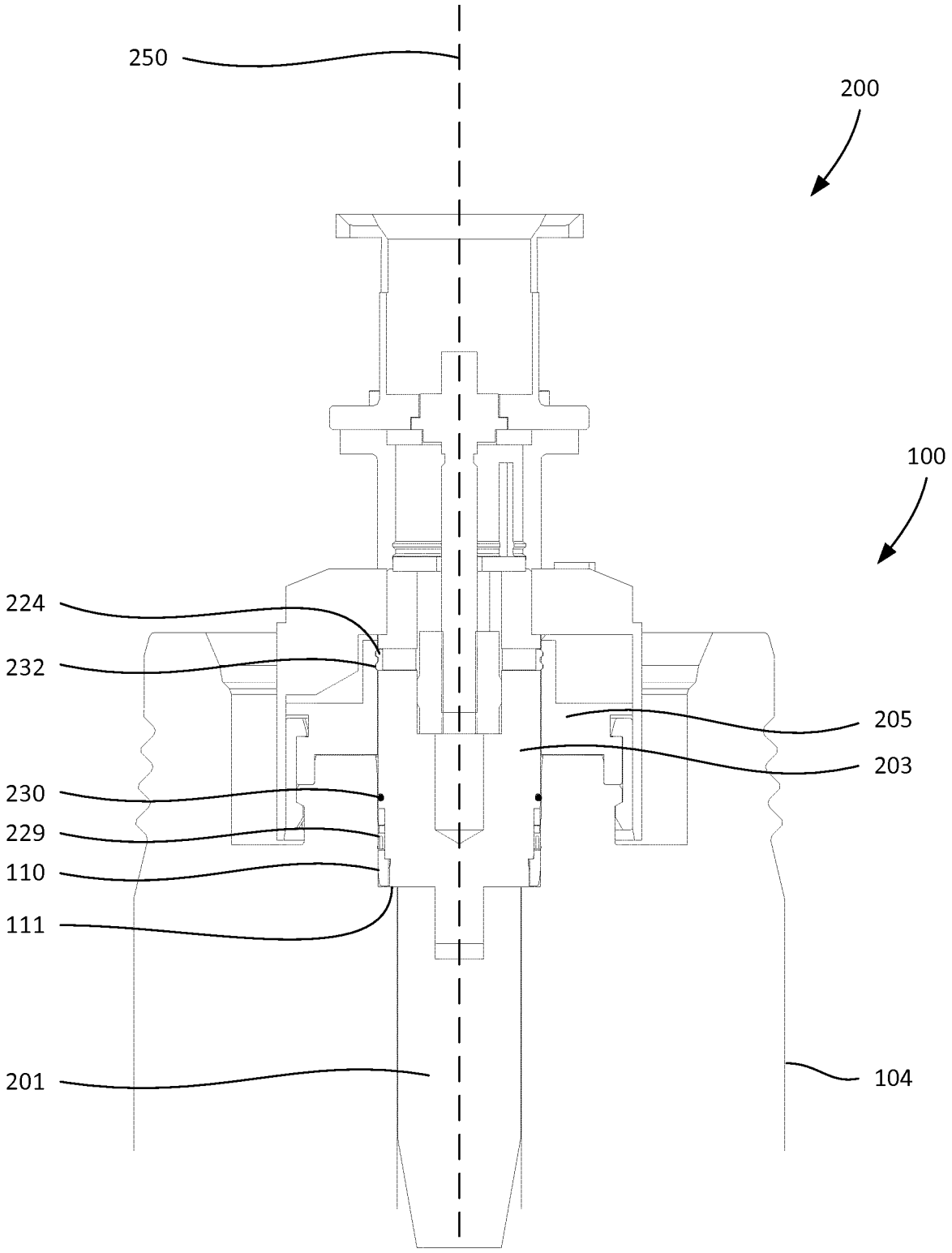
FIG. 9 is a cross-sectional side view of the treehead and cap in which the cap is locked to the treehead in a sealed position.

FIG. 9 shows an operating state of the cap 200 in which the drive nut 215 has urged the sealing portion 203 to a sealed position in which the first and second sealing elements 229, 230 are in contact with the second inner surface 110 of the treehead 104 so as to substantially form a seal therebetween. The sealing portion 203 has been moved to a position in which the lower end of the sealing portion 203 contacts an inwardly extending annular ledge 111 of the treehead 104 and therefore further downwards movement of the sealing portion 203 is substantially prevented. As such, in the position shown in FIG. 9, further rotation of the shaft 208 is resisted by the presence of the annular ledge 111. Furthermore, in the sealed position the lock ring 224 is received within a second locking groove 232 formed in a lower portion of the main body 205.

Figure 10:
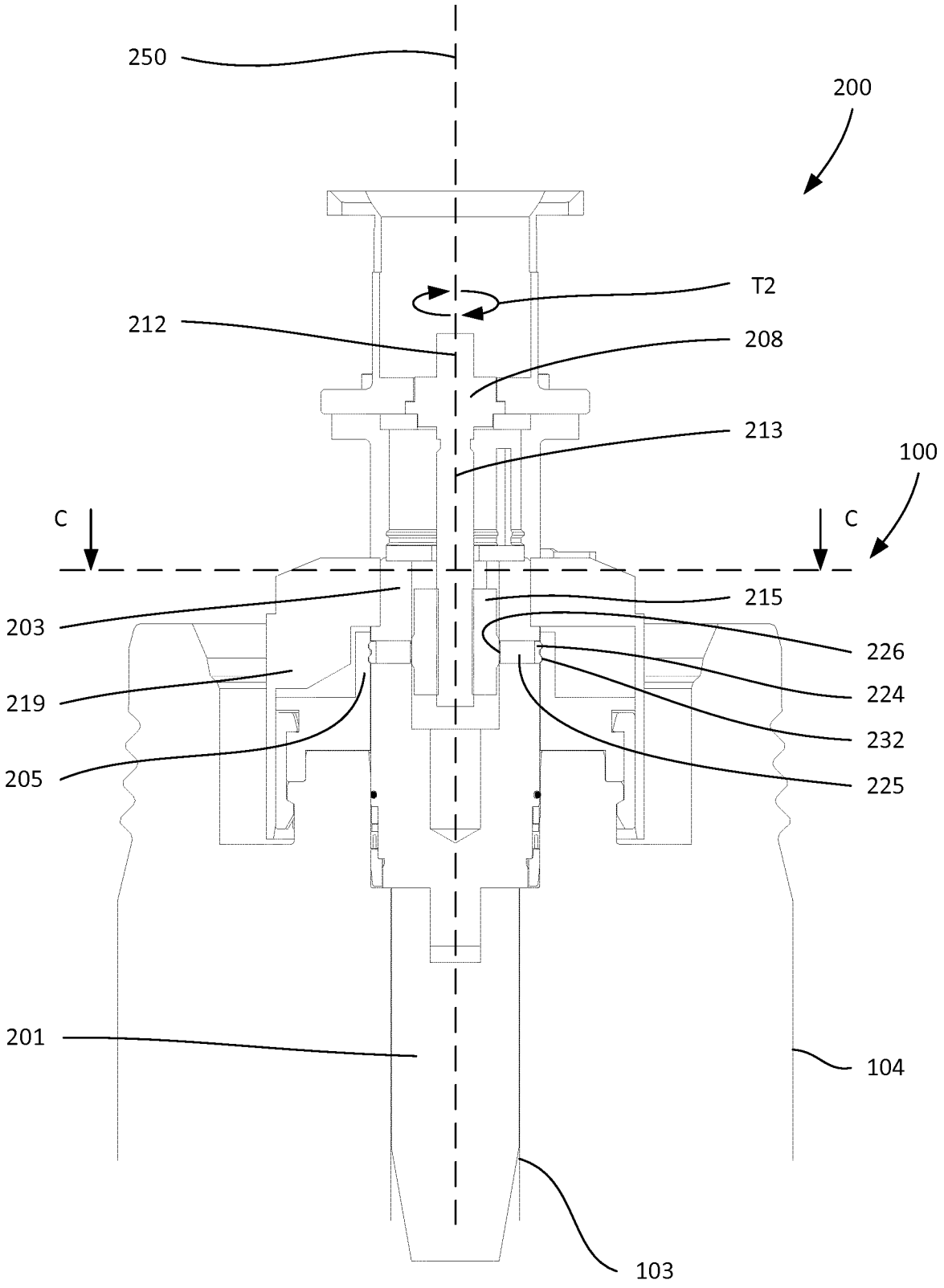
FIG. 10 is a cross-sectional side view of the treehead and cap in which the cap is locked to the treehead in a sealed position and the sealing portion is locked to a body portion of the cap.

FIG. 10 shows an operating state of the cap 200 in which the drive nut 215 has been moved axially upwards along the lower portion 213 of the shaft 208. In order to produce upwards movement of the drive nut 215, a torque T2 is applied to the input portion 212 of the shaft 208 in a second direction opposite the first direction. The drive nut 215 is moved until the cam surface 226 contacts the drive pins 225. In this position, the cam surface 226 substantially prevents movement of the drive pins 225 within the conduits of the sealing portion 203 and hence further prevents resilient deformation of the lock ring 224. As such, the lock ring 224 is unable to deform out of the second locking groove 232 such that the axial position of the production stab 201, sealing portion 203, and the sleeve 219 is fixed relative to the main body 205.

It will be appreciated that the cap 200 converts a relatively small torque into a relatively large longitudinal force in order to move the sealing elements 229, 230 into a sealed position relative to the second inner surface 110. It will be appreciated that the relatively large longitudinal force allows the use of sealing elements which require a high setting force to be used. The setting force required to move the sealing elements 229, 230 to the sealed position relative to the second inner surface 110 is influenced by factors such as the shape and surface finish of the sealing elements 229, 230 and the second inner surface 110, and the material properties (e.g. stiffness, young's modulus, etc.) of the sealing elements 229, 230. The relatively large longitudinal force may allow use of sealing elements 229, 230 which are composed of metal. Metal sealing elements are less prone to degrading in harsh undersea environments and can be manufactured to higher tolerances than equivalent elastomeric seals. As such, the cap 200 can remain in place (in the position shown in FIG. 10) for extended periods of time whilst the well 100 is in use. By contrast, caps which comprise lower quality sealing elements (such as elastomeric sealing elements) may require regular replacement due to degradation of the sealing elements in the undersea environment.

It will be appreciated that in order to provide a high quality seal, the sealing elements 229, 230 must act normal to the inner surface 110 (i.e. radially outwards from the sealing portion 203) to ensure maximum contact is made between the sealing elements 229, 230 and the second inner surface 110. The normal force is typically large, and therefore a high frictional force is produced between the sealing elements 229, 230 and the second inner surface 110 as the sealing elements 229, 230 are moved into the sealed position. As such it will be appreciated that high quality seals typically require a larger setting force (i.e. insertion force) in order to overcome the friction between the sealing elements and the sealing surfaces.

In the position of the drive nut 215 shown in FIG. 10, the valves (not shown) of the treehead 104 may be configured to permit fluid flow communication between the cap 200 and the oil and/or gas well 100. When the valves are opened the pressure of the fluid within the production tubing 103 below the production stab 201 is increased. The increased pressure of the fluid within the production tubing 103 will act upon the production stab 201, sealing portion 203 and first sealing element 229 in an axially upwards direction. This upwards force is transferred through the sealing portion 203 and into the main body 205 via the lock ring 224. Because the main body 205 is secured to the treehead 104 via the latches 216 and the sleeve 219, the latches 216 and sleeve 219 react against the pressure of the fluid in the production tubing 103 to prevent separation of the cap 200 and the treehead 104.

It will be appreciated that fluid within the production tubing 103 is prevented from leaking out of the production tubing 103 by the seal formed between the first sealing element 229 and the second inner surface 110. It will further be appreciated that whilst the nose ring 231 retains the first sealing element 229 upon the sealing portion 203, the nose ring 231 does not act to seal the sealing portion 203 against the treehead 104. It will be appreciated that when the valves of the treehead 104 are configured to permit fluid flow communication between the cap 200 and the oil and/or gas well 100, the valves may also substantially prevent venting of fluid from the production tubing 103 to the surrounding environment.

It will be appreciated that because the resultant force of the fluid pressure inside the production tubing 103 is transferred from the sealing portion 203 to the body portion 205 via the lock ring 224, the drive nut 215 and shaft 208 do not transmit any part the resultant force between the sealing portion 203 and the body portion 205. Embodiments of the present invention therefore may, in an embodiment, prevent the load caused by the pressure of the fluid in the production tubing 103 being distributed through the lead screw mechanism defined between the shaft 208 and the drive nut 215. In this way, the lead screw mechanism may be protected from any potential damage caused by the fluid pressure in the production tubing 103.

Figure 11:
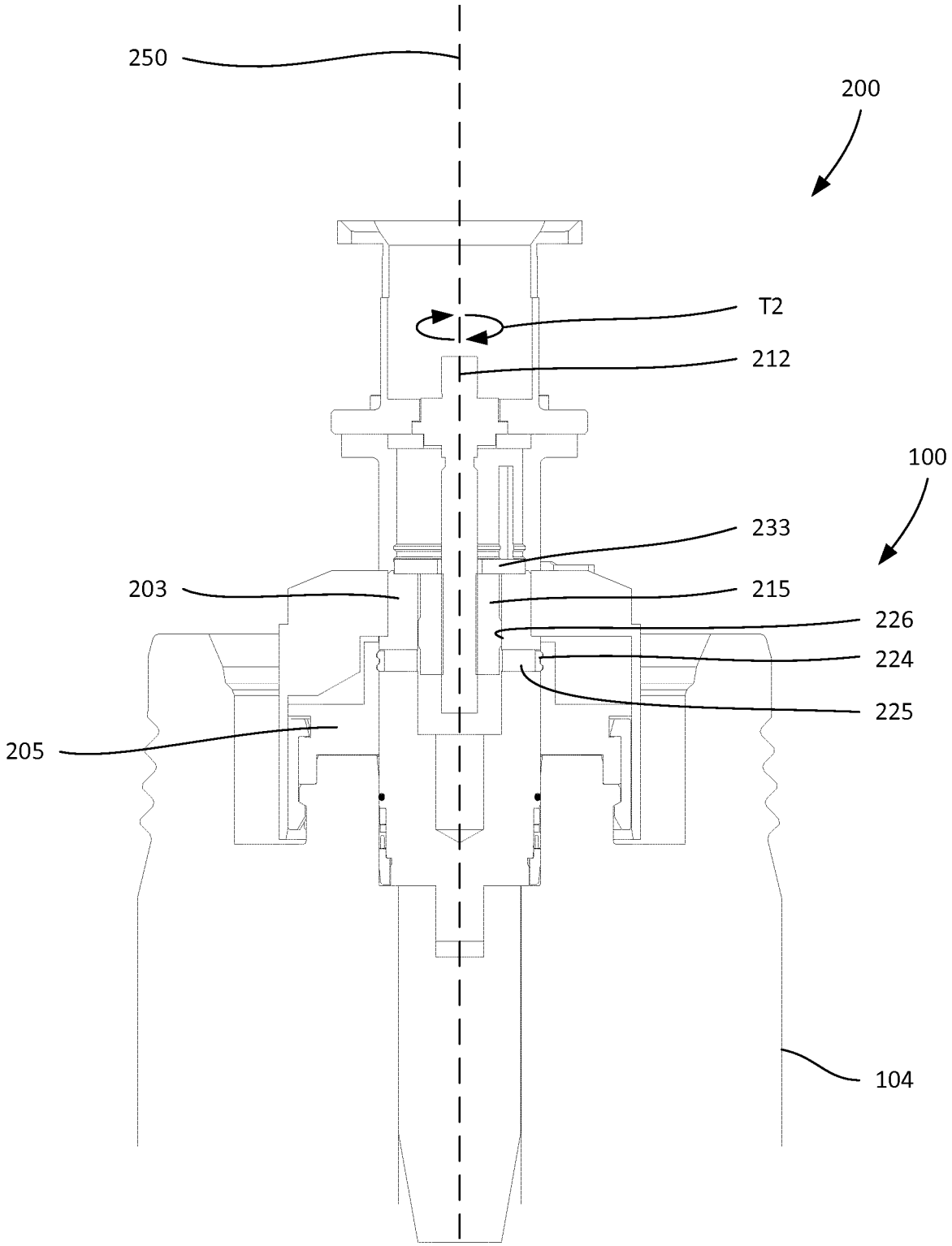
FIG. 11 is a cross-sectional side view of the treehead and cap in which the cap is locked to the treehead in a sealed position and the drive nut is urged against the sealing portion in an upwards direction.
Figure 12:
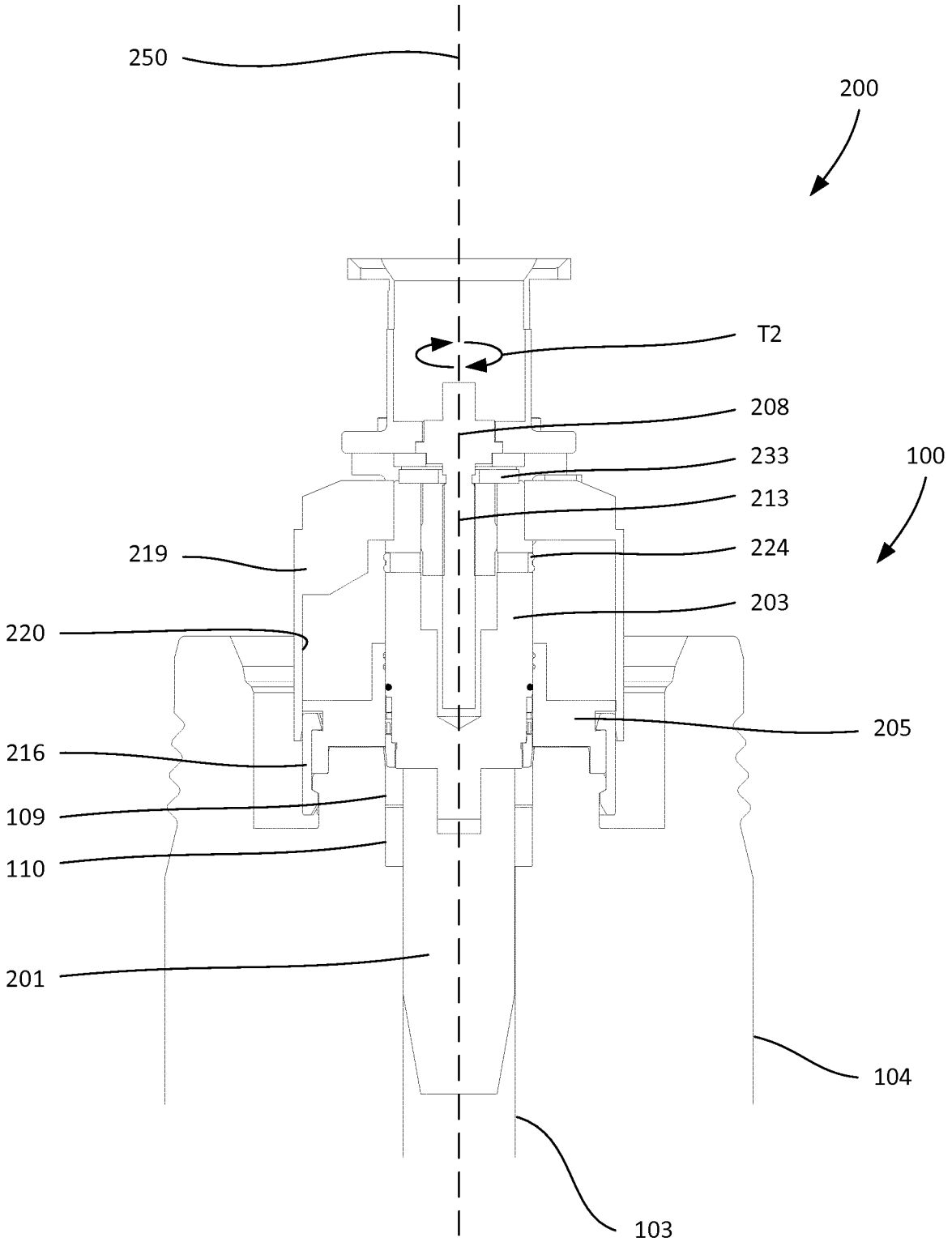
FIG. 12 is a cross-sectional side view of the treehead and cap in which the cap is unlocked from the treehead and the sealing portion is in an unsealed position.
Figure 13:
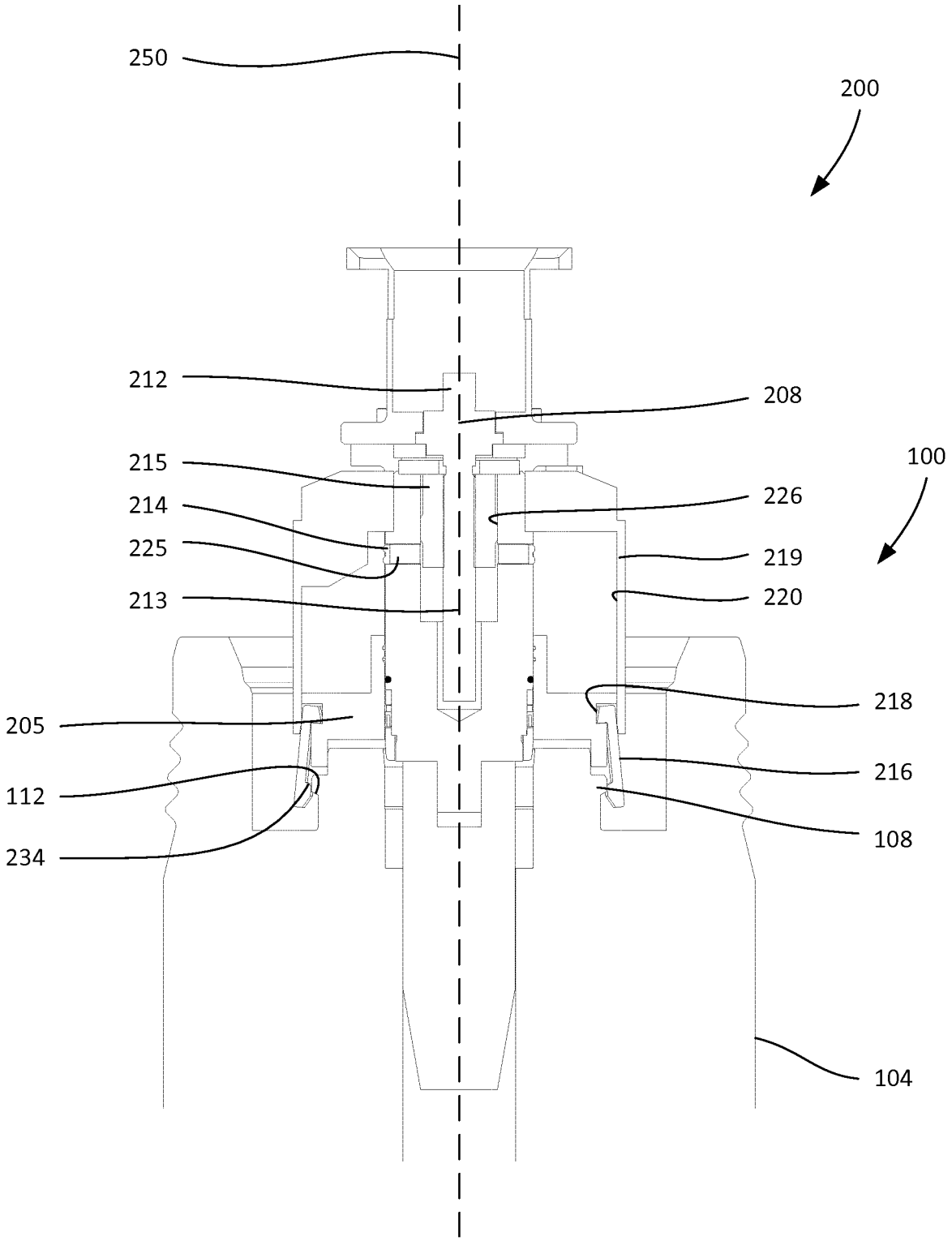
FIG. 13 is a is a cross-sectional side view of the treehead and cap in a partially disengaged state.

FIGS. 11 to 13 illustrate removal of the cap 200 from the treehead. FIG. 11 shows a first stage in the removal of the cap 200 from the treehead 104 of the well 100. Before the cap 200 is removed, the valves of the treehead 104 are closed so as to substantially prevent leakage of oil or gas carried by the production tubing 103 into the environment. The drive nut 215 has been moved axially upwards along the lower portion 213 of the shaft 208 such that an upper portion of the drive nut 215 contacts an annular plate 233 of the sealing portion 203 whilst the cam surface 226 no longer contacts the drive pins 225. As such, the lock ring 224 is able to resiliently deform out of the second locking groove 232 so as to permit relative movement between the sealing portion 203 and the main body 205. The annular plate 233 is attached to the sealing portion 203 at an upper end of the sealing portion 203. It will be appreciated that the annular plate 203 may be attached to the sealing portion 203 via any suitable means such as, for example, by bolting or welding. Continued rotation of the shaft 208 in the second direction urges the drive nut 215 against the annular plate 233 to cause upwards movement of the sealing portion 203 relative to the main body 205.

FIG. 12 shows a second stage in the removal of the cap 200 from the treehead 104 of the well 100. The drive nut 215 has been moved axially upwards in contact with the annular plate 233 to remove the sealing portion 203 from the interior of the treehead 104 defined by the first and second inner surfaces 109, 100. The sealing portion 203 is positioned such that the lock ring 224 is received within the first locking groove 227 of the main body 205. Due to movement of the sealing portion 203, both the production stab 201 and the sleeve 219 are also moved axially upwards relative to the main body 205, and therefore the inner surface 220 of the sleeve 219 no longer surrounds the latches 216. It will be appreciated that in the position shown in FIG. 12, the sleeve 219 no longer acts to lock the cap 200 to the treehead 104.

FIG. 13 shows a third stage in the removal of the cap 200 from the treehead 104 of the well 100. Because the latches 216 are no longer surrounded by the inner face 220 of the sleeve 219, the latches 216 are able to tilt within the circumferential groove 218 of the main body 205 in response to a lifting force exerted on the cap 200 by the ROV 300 in an axially upwards direction. The latches 216 define a first latch surface 234 which is configured to engage a second latch surface 112 of the locking portion 108. The first and second latch surfaces are inclined at a non-perpendicular angle relative to the direction of the lifting force. As such, in response to the lifting force, the first latch surface 234 of the latches 216 slides over the second latch surface 112 of the locking portion 108 to permit the latches 216 to disengage from the locking portion 108 of the treehead 104. Once the latches 216 are disengaged, the ROV 300 is then able to lift the entire cap 200 off the treehead 104.

Although not shown, an input torque may be applied to the input portion 212 to rotate the shaft 208 in the first direction which causes downwards movement of the drive nut 215 along the lower portion 213 of the shaft 208. The input torque is removed once the cam surface 226 of the drive nut 215 is positioned behind the drive pins 225 of the sealing portion 203 (i.e. the shown position of the drive nut 215 shown in FIG. 2). This prevents resilient deformation of the lock ring 214, and prevents movement of the production stab 201, sealing portion 203, and sleeve 219 relative to the main body 205.

Figure 14:
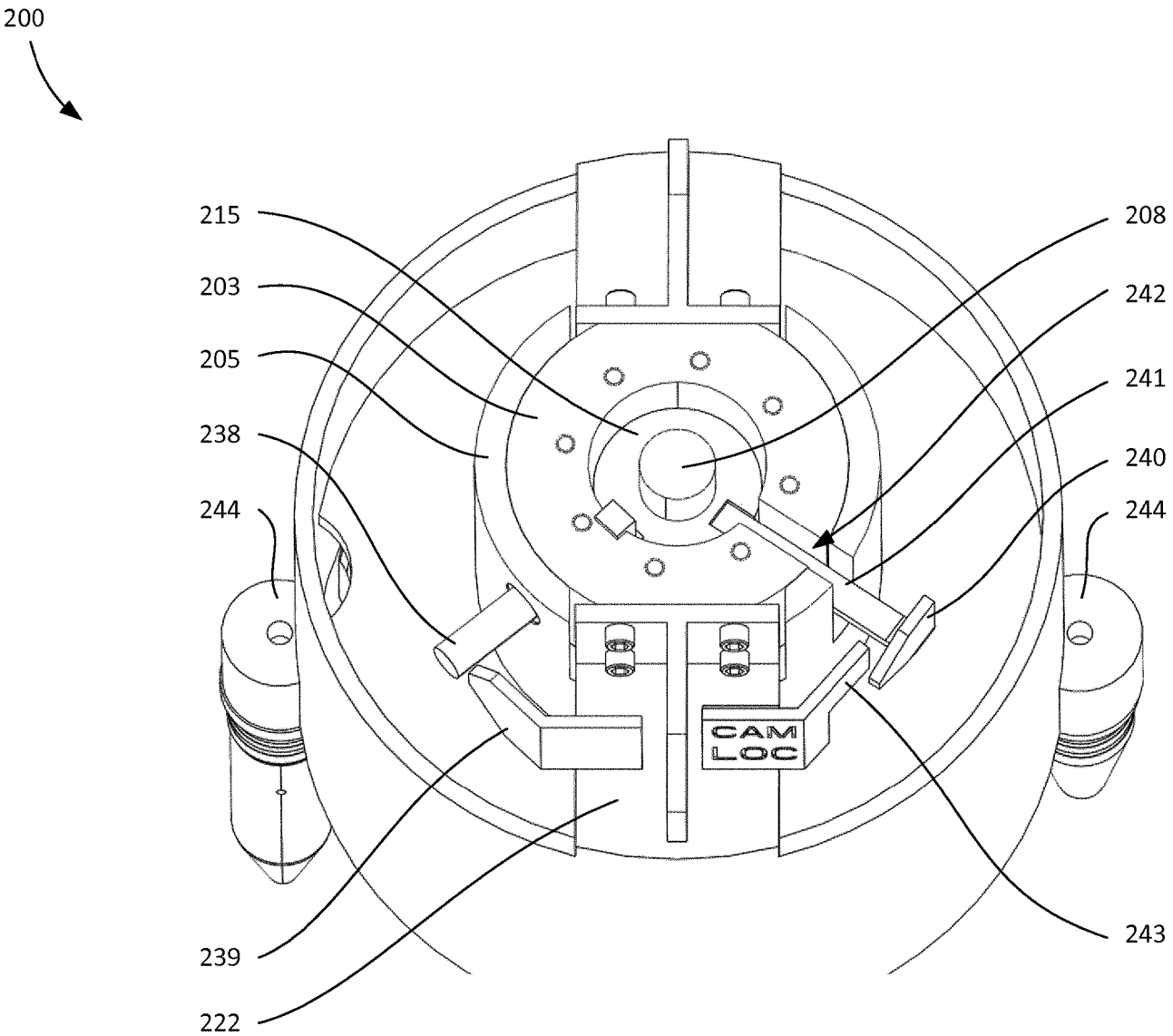
FIG. 14 is a perspective view of a cross-section of the cap taken along section C-C of FIG. 10.

FIG. 14 is a perspective view of a cross-section of the cap 200 taken along the section C-C of FIG. 10. The cap 200 is in the same operating state as shown in FIG. 10, in which the sealing portion 203 is in the sealed position, and the drive nut 215 is positioned such that the cam surface 226 is in contact with the drive pins 225 to lock the sealing portion 203 to the main body 205.

The main body 205 comprises a first marker 238 extending radially outwards from the main body 205 in a direction substantially perpendicular to the longitudinal axis 250 of the cap 200. The bridge 222 of the sleeve 219 comprises a second marker 239 which extends perpendicularly to the longitudinal axis 250 of the cap 200 from the bridge 222 of the sleeve 219 towards the first marker 238. Because the second marker 239 is connected to (or is integral with) the sleeve 219, the second marker 239 moves with the sleeve 219 and sealing portion 203 in response to the urging of the drive nut 215 against the sealing portion 203.

The drive nut 215 comprises a third marker 240 connected to the drive nut 215 via an arm 241. The third marker 240 is positioned radially outwards of the sealing portion 203 and the main body 205. As such, the arm 241 extends from the drive nut 215 to the third marker 240 through a slot 242 defined by both the main body 205 and the sealing portion 203. The slot 242 extends parallel to the longitudinal axis 250 of the cap 200 in order to permit the third marker 240 to move with the drive nut 215 along the longitudinal axis 250. The bridge 222 of the sleeve 219 further comprises a further marker 243, which extends from the bridge 220 perpendicularly to the longitudinal axis 250 of the cap 200 towards the third marker 240. Because the fourth marker 243 is connected to (or is integral with) the sleeve 219, the fourth marker 243 moves with the sleeve 219 and sealing portion 203 in response to the urging of the drive nut 215 against the sealing portion 203.

Figure 15:
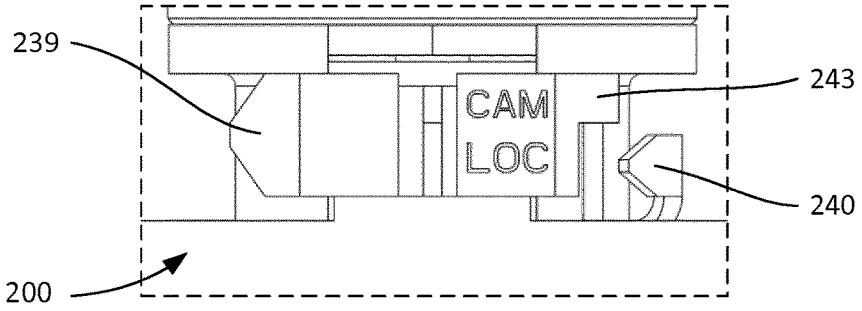
FIG. 15 is an enlarged side view of a visual indicator portion of the cap in the state shown in FIG. 7.

FIG. 15 shows an enlarged side view of the cap 200 in the operating state shown in FIG. 7, when the sealing portion 203 is in an unsealed position and the drive nut 215 has been moved downwardly along the longitudinal axis 250 to engage the sealing portion 203. Because the sealing portion 203 is in an unsealed position, the second marker 239 has not yet been moved to a position adjacent the first marker 238, and therefore the first marker 238 is not visible in FIG. 15. This acts as a visual indication to the operator of the ROV 300 that the sealing portion 203 has not yet been moved to the sealed position. Because the drive nut has moved down the longitudinal axis 250 to engage the sealing portion 203, the third marker 240 has moved from a position adjacent the fourth marker 243 to a position below the fourth marker 240. This acts as a visual indication that the cam surface 226 of the drive nut 215 is no longer in contact with the drive pins 225 and therefore the lock ring 224 may be disengaged from the main body 205. This position of the fourth marker 243 further indicates that the drive nut 215 is engaged against the sealing portion 203 ready to urge the sealing portion 203 along the longitudinal axis 250. It will be appreciated that in order to view the markers, the ROV 300 is typically equipped with a camera which transmits a live image of the markers of the cap 200 to an operator.

Figure 16:
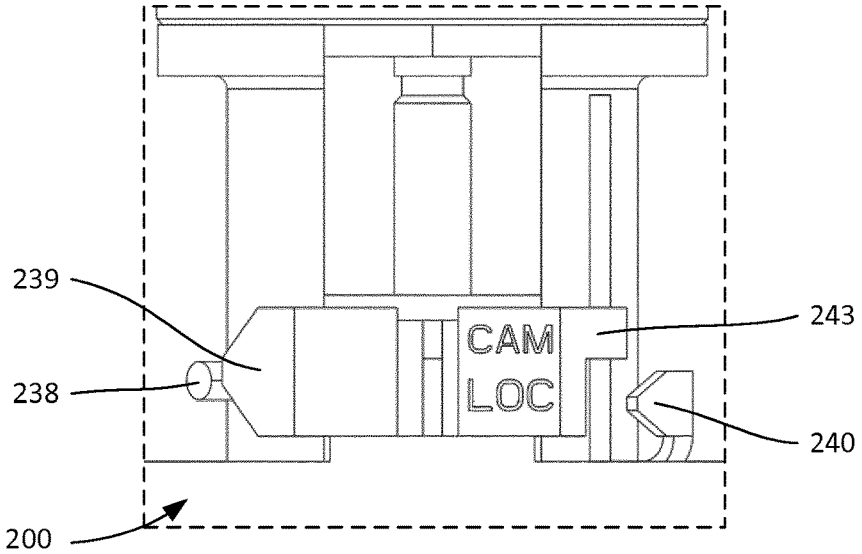
FIG. 16 is an enlarged side view of the visual indicator portion of the cap in the state shown in FIG. 9.

FIG. 16 shows an enlarged side view of the cap 200 in the operating state shown in FIG. 9, when the sealing portion 203 is in the sealed position and the drive nut 215 is still engaged against the sealing portion 203. Because the sealing portion 203 is in the sealed position, the second marker 239 is positioned adjacent the first marker 238. This acts as a visual indication that the sealing portion 203 has been moved along the longitudinal axis as far as possible, and in turn this indicates to the operator that further rotation of the shaft 208 should be stopped so as to prevent damage to the cap 200 or the tool 301 of the ROV 300. Furthermore, because the drive nut 215 is engaged with the annular ledge 228 of the sealing portion 203, the third marker 240 is positioned below the fourth marker 243. This acts as a visual indication that although the sealing portion 203 is in the sealed position, the sealing portion 203 is not yet locked to the main body 205 via the lock ring 224.

Figure 17:
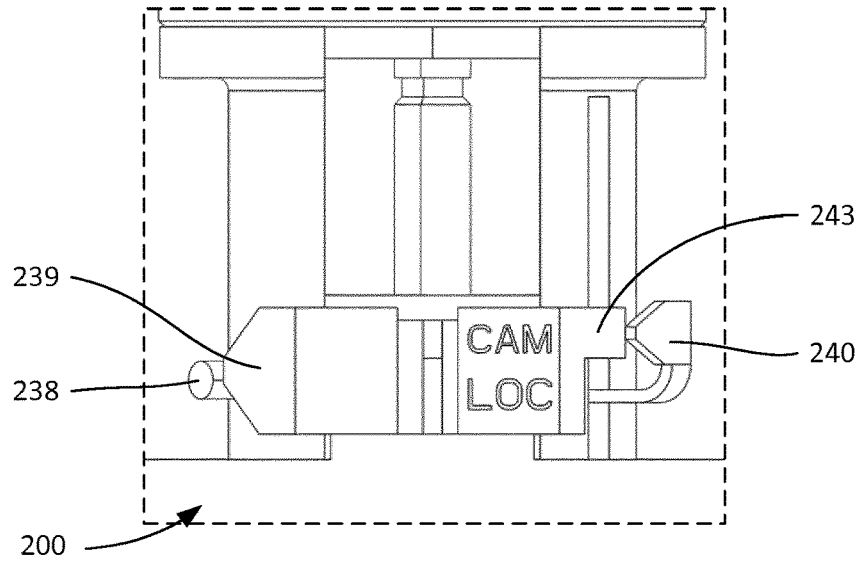
FIG. 17 is an enlarged side view of the visual indicator portion of the cap in the state shown in FIG. 10.

FIG. 17 shows an enlarged side view of the cap 200 in the operating state shown in FIG. 10, when the sealing portion 203 is in the sealed position and the cam surface 226 of the drive nut 215 is engaged with the drive pins 225. As shown in FIG. 16, because the sealing portion 203 is in the sealed position, the second marker 239 is positioned adjacent the first marker 238. However, in this state the third marker 240 has moved with the drive nut 215 such that it is positioned level with the fourth marker 243. This acts as a visual indication that the cam surface 226 of the drive nut 215 is engaged with the drive pins 225 so as to prevent the lock ring 224 from disengaging from the main body 205.

With reference to FIGS. 3 and 14, the sleeve 219 may further comprise a pair of side stabs 244. Each side stab is configured for receipt by a longitudinally extending conduit of the treehead 104 which is connected to an annulus of the wellbore 102. It will be understood that an annulus of the wellbore 102 is an annular region of fluid defined between concentrically aligned casings or tubings of the well 100. The side stabs 244 comprise sealing elements configured to substantially seal the side stabs 244 against the longitudinally extending conduits of the treehead 104. However, it will be appreciated that a cap 200 according to embodiments of the present invention may not comprise the side stabs 244, or may comprise a single side stab 244, or any number of side stabs 244.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A sealing arrangement for an oil and/or gas well, comprising:

a rotation portion;

a sealing portion defining conduits;

a resiliently deformable lock ring configured to engage the sealing portion so as to substantially restrict relative movement between the sealing arrangement and a surface of the oil and/or gas well;

drive pins, each drive pin located within a portion of a respective one of the conduits of the sealing portion; and a drive nut arranged between the rotation portion and the sealing portion, the drive nut defining a cam surface configured to contact the drive pins;

wherein rotation of the rotation portion (i) causes linear movement of the drive nut on the rotation portion, the drive nut abutting the sealing portion to cause linear movement of the sealing portion to engage a surface of the oil and/or gas well so as to substantially form a seal therebetween, and (ii) causes the cam surface to contact the drive pins to substantially prevent deformation of the lock ring.

2. The sealing arrangement according to claim 1, wherein the sealing arrangement further comprises a first locking arrangement configured to engage the oil and/or gas well.

3. The sealing arrangement according to claim 2, wherein the first locking arrangement is configured to engage the oil and/or gas well such that rotation of the rotation portion urges the sealing portion to a sealed position in which the seal is formed between the sealing portion and the surface of the oil and/or gas well.

4. The sealing arrangement according to claim 3, wherein urging of the sealing portion to the sealed position causes linear movement of the sealing portion.

5. The sealing arrangement according to claim 4, wherein the sealing arrangement comprises a first keyway configured to substantially restrict rotation of the sealing portion relative to the sealing arrangement so as to cause linear movement of the sealing portion when the rotation portion is rotated.

6. The sealing arrangement according to claim 2, wherein the seal is formed under the application of a setting force and wherein the first locking arrangement is configured to maintain engagement of the sealing arrangement and the oil and/or gas well during application of the setting force.

7. The sealing arrangement according to claim 2, wherein the first locking arrangement comprises a retaining member configured to retain the locking arrangement in an engaged state with the oil and/or gas well.

8. The sealing arrangement according to claim 2, wherein the first locking arrangement comprises a latch configured to engage a locking portion of the oil and/or gas well.

9. The sealing arrangement according to claim 8, wherein the first locking arrangement is configurable between a first state in which the latch is movable relative to the oil and/or gas well and a second state in which movement of the latch relative to the oil and/or gas well is restricted.

10. The sealing arrangement according to claim 1, wherein the sealing arrangement further comprises a sealing element, the sealing element configured to engage the surface of the oil and/or gas well so as to substantially form the seal therebetween.

11. The sealing arrangement according to claim 10, wherein the sealing element is composed of metal.

12. The sealing arrangement according to claim 1, wherein the drive nut is supported by the rotation portion, wherein the drive nut is configured to urge the sealing arrangement such that the sealing arrangement engages the surface of the oil and/or gas well.

13. The sealing arrangement according to claim 12, wherein the sealing arrangement further comprises a second keyway defined between the sealing portion and the drive nut, the second keyway being configured to substantially restrict rotation of the drive nut relative to the sealing portion.

14. The sealing arrangement according to claim 1, wherein the sealing arrangement comprises a body portion configured to engage the oil and/or gas well.

15. The sealing arrangement according to claim 14, wherein the rotation portion is supported for rotation by the body portion.

16. The sealing arrangement according to claim 14, wherein the body portion further comprises a socket configured to receive a portion of a rotation tool.

17. The sealing arrangement according to claim 14, wherein the sealing arrangement further comprises:

a second locking arrangement;

wherein the second locking arrangement is configured to engage the sealing portion with the body portion.

18. The sealing arrangement according to claim 17, wherein the sealing arrangement comprises a first visual indicator configured to indicate a locked position of the second locking arrangement.

19. The sealing arrangement according to claim 1, wherein rotation of the rotation portion in a first direction causes the sealing arrangement to engage a surface of the oil and/or gas well and wherein rotation of the rotation portion in a second direction substantially opposite the first direction causes the sealing arrangement to disengage the surface of the oil and/or gas well.

20. The sealing arrangement according to claim 1, wherein the rotation portion is a shaft.

21. The sealing arrangement according to claim 1, wherein the rotation portion comprises an input portion configured to receive a rotational input.

22. The sealing arrangement according to claim 1, wherein the sealing arrangement further comprises a second visual indicator configured to indicate a sealed position of the sealing arrangement.

23. A method of forming a seal using a sealing arrangement according to claim 1, wherein the method comprises rotating the rotation portion so as to cause the sealing arrangement to engage the surface of the oil and/or gas well.

24. An oil and/or gas well, comprising:

a wellbore;

a treehead in fluid flow communication with the wellbore; and the sealing arrangement according to claim 1.

* * * * *